US011506042B2

(12) United States Patent
Lo Cascio et al.

(10) Patent No.: US 11,506,042 B2
(45) Date of Patent: Nov. 22, 2022

(54) DOWNHOLE PRODUCTION FLUID FRACTIONATION SYSTEM

(71) Applicant: ExxonMobil Upstream Research Company, Spring, TX (US)

(72) Inventors: Mauro Lo Cascio, Houston, TX (US); Andrey A. Troshko, Spring, TX (US); Michael T. Hecker, Houston, TX (US); Matthew S. Jackson, Houston, TX (US); Dragan Stojkovic, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 51 days.

(21) Appl. No.: 17/077,910

(22) Filed: Oct. 22, 2020

(65) Prior Publication Data

US 2021/0180440 A1 Jun. 17, 2021

Related U.S. Application Data

(60) Provisional application No. 62/947,646, filed on Dec. 13, 2019.

(51) Int. Cl.
*E21B 43/38* (2006.01)
*E21B 33/124* (2006.01)

(52) U.S. Cl.
CPC ..... *E21B 43/385* (2013.01); *E21B 33/124* (2013.01)

(58) Field of Classification Search
CPC ..... E21B 43/385; E21B 43/40
See application file for complete search history.

(56) References Cited

U.S. PATENT DOCUMENTS

| | | | |
|---|---|---|---|
| 7,661,476 | B2 | 2/2010 | Yeh et al. |
| 7,938,164 | B2 | 5/2011 | Blejde et al. |
| 7,971,642 | B2 | 7/2011 | Yeh et al. |
| 7,984,760 | B2 | 7/2011 | Haeberle et al. |
| 8,011,437 | B2 | 9/2011 | Yeh et al. |

(Continued)

FOREIGN PATENT DOCUMENTS

WO WO2014077947 A1 5/2014

*Primary Examiner* — Robert E Fuller
(74) *Attorney, Agent, or Firm* — ExxonMobil Upstream Research Company—Law Department

(57) ABSTRACT

An oil-water fractionation system is positioned within a wellbore on a subsurface end of a production tubing proximate to a production region. The fractionation system includes a permeable hydrophobic media for preferentially conveying an oil-enriched stream (reduced water-cut presence) from the production region into the production tubing, and a permeable oleophobic media for preferentially conveying a water-enriched stream (reduced oil-cut presence) into a second flow path. The permeable hydrophobic media and the permeable oleophobic media are in simultaneous hydraulic communication with the production region. The permeable hydrophobic media is manufactured with a relatively high effective permeability to oil, allowing the oil-enriched stream to flow through the permeable hydrophobic media into the production tubing. In contrast, the permeable oleophobic media is manufactured with a relatively high effective permeability to water, allowing the water-enriched stream to flow through the permeable oleophobic media into the second flow path.

17 Claims, 7 Drawing Sheets

(56) References Cited

U.S. PATENT DOCUMENTS

| | | | |
|---|---|---|---|
| 8,127,831 | B2 | 3/2012 | Haeberle et al. |
| 8,186,429 | B2 | 5/2012 | Yeh et al. |
| 8,215,406 | B2 | 7/2012 | Dale et al. |
| 8,286,715 | B2 | 10/2012 | Bailey et al. |
| 8,347,956 | B2 | 1/2013 | Yeh et al. |
| 8,356,664 | B2 | 1/2013 | Yeh et al. |
| 8,403,062 | B2 | 3/2013 | Dale et al. |
| 8,430,160 | B2 | 4/2013 | Yeh et al. |
| 8,517,098 | B2 | 8/2013 | Dale et al. |
| 8,584,749 | B2 | 11/2013 | Troshko et al. |
| 8,590,627 | B2 | 11/2013 | Jin et al. |
| 8,656,996 | B2 | 2/2014 | Willingham et al. |
| 8,657,000 | B2 | 2/2014 | Willingham et al. |
| 8,739,869 | B2 | 6/2014 | Willingham et al. |
| 8,789,612 | B2 | 7/2014 | Haeberle et al. |
| 8,839,861 | B2 | 9/2014 | Yeh et al. |
| 9,068,447 | B2 | 6/2015 | Alvarez et al. |
| 9,187,977 | B2 | 11/2015 | Alvarez et al. |
| 9,303,485 | B2 | 4/2016 | Hecker et al. |
| 9,322,248 | B2 | 4/2016 | Yeh et al. |
| 9,441,474 | B2 | 9/2016 | Yale et al. |
| 9,593,559 | B2 | 3/2017 | Yeh et al. |
| 9,816,361 | B2 | 11/2017 | Yeh et al. |
| 10,012,032 | B2 | 7/2018 | Yeh et al. |
| 10,107,093 | B2 | 10/2018 | Yeh et al. |
| 10,443,370 | B2 | 10/2019 | Wang et al. |
| 10,450,848 | B2 | 10/2019 | Wang et al. |
| 10,662,746 | B2 | 5/2020 | Jackson |
| 10,934,830 | B2 | 3/2021 | Wang et al. |
| 2009/0014171 | A1* | 1/2009 | Woie ..... E21B 43/385 166/266 |
| 2012/0175127 | A1 | 7/2012 | Yale et al. |
| 2012/0211228 | A1 | 8/2012 | Troshko et al. |
| 2013/0014944 | A1* | 1/2013 | Mazyar ..... E21B 43/385 977/902 |
| 2013/0025856 | A1* | 1/2013 | Ramakrishnan ..... E21B 43/38 166/266 |
| 2015/0041123 | A1 | 2/2015 | Troshko et al. |
| 2015/0240602 | A1 | 8/2015 | Troshko et al. |
| 2020/0095851 | A1 | 3/2020 | Stojkovic et al. |
| 2020/0208496 | A1 | 7/2020 | Veselka et al. |

* cited by examiner

100

102

102

300

300

400

500

DOWNHOLE PRODUCTION FLUID FRACTIONATION SYSTEM

CROSS-REFERENCE TO RELATED APPLICATION

This application claims the benefit of U.S. Provisional Application 62/947,646 filed Dec. 13, 2019 entitled "DOWNHOLE PRODUCTION FLUID FRACTIONATION SYSTEM", the entirety of which is incorporated by reference herein.

FIELD

The techniques described herein relate to the field of well completions and downhole operations. More particularly, the techniques described herein relate to a downhole fractionation system and method for separating production fluid (oil and water) in the subsurface.

BACKGROUND

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

Hydrocarbon wells typically produce a variety of fluids over the course of their lifespan. Those fluids primarily include some combination of hydrocarbons, various gases and water. The fraction of each component varies by reservoir and through time, with the fraction of water and natural gas typically increasing relative to the fraction of oil. Water generally has low value at the surface and requires costs to lift from the wellbore, separate, and make disposition thereof after it's produced, water is generally considered an unwanted but necessary component of production fluids. Even though they are considered immiscible fluids, specialized surface equipment and chemicals are typically needed to separate the water from the hydrocarbons (oil and natural gas). Disposition has to be made for separated water, either by re-injecting the same, using the water in other facets of reservoir maintenance, or disposing of the same. Regulations also frequently require cleaning or treating the water to meet certain specifications before it can be used or disposed of. Producing water also can lead to additional complications such as scaling issues in production facilities, wellbores, or injection wells.

It is ideal if undesirable fluids associated with hydrocarbon production such as formation water never reached the surface. Various techniques have been attempted to separate fluids in the subsurface. However, space within the confines of a wellbore are very limited. They're also very remote with respect to the surface of the wellbore. Various equipment have been utilized to find an acceptable solution, such as hydrocyclones, mechanical pumps, wellbore gravity separators, strategically positioning pumping equipment have all been considered. Many of these methods and equipment require downhole power to separate the oil and water, separate from lifting power. Reliability, effectiveness, and expense are all issues with these known methods. Need still exists for a more reliable, more cost-effective technique for separating fluids in the subsurface, particularly a technique that does not require power.

SUMMARY

An embodiment described herein provides a well completion including a wellbore with a production tubing positioned within the wellbore. The production tubing has a surface end proximate a surface region and a subsurface end proximate a subsurface region. The production tubing conveys at least a first portion of a production fluid from the subsurface region to the surface region. The well completion also includes a fractionation (separation) system positioned within the wellbore on the subsurface end of the production tubing proximate to a production region of the wellbore. The fractionation system includes a permeable hydrophobic media for preferentially conveying at least the first portion of the production fluid (e.g., oil) from the production region into the production tubing, and a permeable oleophobic media for preferentially conveying at least a second portion of the production fluid (water) from the production region into a second or another flow path. The permeable hydrophobic media and the permeable oleophobic media are in simultaneous hydraulic communication with the production region. The permeable hydrophobic media is manufactured to provide a relatively high effective permeability to oil (and a relatively low effective permeability to water), whereby the first portion of the production fluid includes an oil-enriched stream that flows through the permeable hydrophobic media into the production tubing and is conveyed to the surface region. The permeable oleophobic media is manufactured to provide a relatively high effective permeability to water (and a relatively low effective permeability to oil), whereby the second portion of the production fluid includes a water-enriched stream that flows through the permeable oleophobic media into the second flow path for disposing of the water-enriched stream.

Another embodiment described herein provides a method for separating a production fluid in a subsurface region within a wellbore. The method includes flowing a production fluid from a reservoir into a production region of a wellbore. The production region is located within a subsurface region of the wellbore that is proximate to a subsurface end of a production tubing positioned within the wellbore. The method also includes conveying at least a first portion of the production fluid from the production region into the production tubing via a fractionation system. The fractionation system is positioned within the wellbore on the subsurface end of the production tubing. The fractionation system includes a permeable hydrophobic media and a permeable oleophobic media that are in simultaneous hydraulic communication with the production region. The permeable hydrophobic media is manufactured to provide a relatively high effective permeability to oil, whereby the first portion of the production fluid includes an oil-enriched stream that flows through the permeable hydrophobic media into the production tubing and is conveyed to a surface region of the wellbore. The method also includes conveying at least a second portion of the production fluid from the production region into a second flow path via the fractionation system. The permeable oleophobic media is manufactured to provide relatively high effective permeability to water, whereby the second portion of the production fluid includes a water-enriched stream that flows through the permeable oleophobic media into the second flow path for disposing of the water-enriched stream.

Another embodiment described herein provides a fractionation system. The fractionation system includes a permeable hydrophobic media and a permeable oleophobic media. The permeable hydrophobic media and the permeable oleophobic media are in simultaneous hydraulic communication with a fluid including oil and water. The permeable hydrophobic media is manufactured to provide a relatively high effective permeability to oil, whereby an oil-enriched stream flows through the permeable hydrophobic media into a first flow path. The permeable oleophobic media is manufactured to provide a relatively high effective permeability to water, whereby a water-enriched stream flows through the permeable oleophobic media into a second flow path.

Another embodiment described herein provides a well completion including a wellbore with a production tubing positioned within the wellbore. The production tubing has a surface end proximate a surface location and a subsurface end proximate a subsurface region. The well completion also includes a production region in the wellbore in an annular area between the wellbore and the production tubing for receiving therein a production fluid from the subsurface region, the production fluid including oil and water. The well completion further includes a fractionation system positioned within the wellbore on a subsurface end of the production tubing and in hydraulic communication with the production region. The fractionation system includes a permeable hydrophobic media including (i) an effective permeability to oil through the permeable hydrophobic media that conveys at least an oil-enriched portion of the production fluid from the production region along a first flow path conveying oil from the production region, through the permeable hydrophobic media, and into the production tubing, and (ii) simultaneously an effective permeability to water through the permeable hydrophobic media that impedes conveyance of water from the wellbore region into the production tubing. The fractionation system also includes a permeable oleophobic media including (i) an effective permeability to water through the permeable oleophobic media that conveys at least a water-enriched portion of the production fluid from the production region to a second flow path hydraulically isolated from the first flow path, the second flow path conveying water from the permeable oleophobic media to another subsurface region of the wellbore for disposal of the conveyed water, and (ii) simultaneously an effective permeability to oil through the permeable oleophobic media that impedes conveyance of oil from the production region to the second flow path. The production region is in simultaneous fluid communication with a reservoir, the permeable hydrophobic media, and the permeable oleophobic media.

A method for producing fluid from a subsurface region using a wellbore, the method comprising: positioning a production tubing within a wellbore, the production tubing having a surface end proximate a surface location and a subsurface end proximate a subsurface region; flowing a wellbore fluid from the subsurface region into a production region in the wellbore, the production region located hydraulically intermediate the subsurface region and the production tubing, the wellbore fluid comprising an immiscible combination of a hydrocarbon phase and a water phase; and providing a fractionation system within the wellbore on a subsurface end of the production tubing and forming a portion of the production tubing, the fractionation system in hydraulic communication with the production region, and the fractionation system separating at least a portion of the hydrocarbon phase from at least a portion of the water phase by the steps of; (a) preferentially conveying at least a portion of the hydrocarbon phase from the production region along a first hydraulic flow path through a permeable hydrophobic media and into the production tubing while inhibiting flow of the water phase along the first hydraulic flow path to the production tubing, wherein the first hydraulic flow path along the permeable hydrophobic media includes (i) an effective permeability to the hydrocarbon phase fluid in the production region, and (ii) simultaneously, a lower effective permeability to the water phase fluid in the production region relative to the effective permeability to the hydrocarbon phase fluid; and (b) preferentially conveying at least a portion of the water phase from the production region along another hydraulic flow path through a permeable oleophobic media to another region within the wellbore for water disposition, while restricting conveyance of the hydrocarbon phase along the another hydraulic flow path, wherein the another hydraulic flow path along the permeable oleophobic media includes (i) an effective permeability to the water phase fluid from the production region, and (ii) simultaneously, a restricted effective permeability to the hydrocarbon phase fluid from the production region relative to the effective permeability to the water phase fluid; wherein the fractionation system conveys at least one of a hydrocarbon fluid and a hydrocarbon-enriched fluid cut from the hydrophobic media into the production tubing, with respect to a hydrocarbon cut of the produced fluid within the production region of the wellbore.

DESCRIPTION OF THE DRAWINGS

The foregoing and other advantages of the present techniques may become apparent upon reviewing the following detailed description and drawings of non-limiting examples in which.

Figure 1:
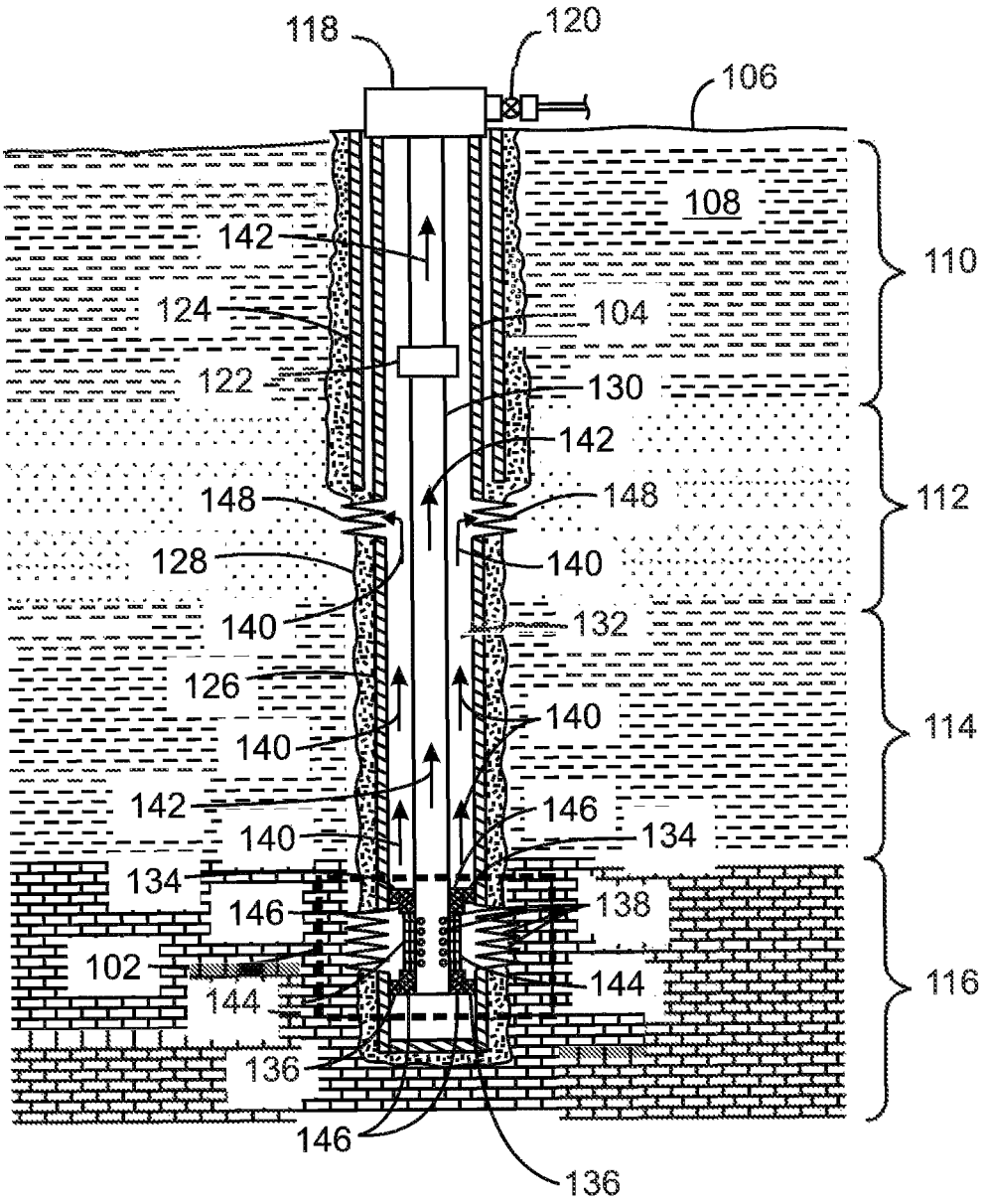
FIG. 1 is a cross-sectional schematic view of a vertical well that includes an exemplary fractionation system.

It should be noted that the figures are merely examples of the present techniques, and no limitations on the scope of the present techniques are intended thereby. Further, the figures are generally not drawn to scale, but are drafted for purposes of convenience and clarity in illustrating various aspects of the techniques.

DETAILED DESCRIPTION

In the following detailed description section, the specific examples of the present techniques are described in connection with preferred embodiments. However, to the extent that the following description is specific to a particular embodiment or a particular use of the present techniques, this is intended to be for example purposes only and simply provides a description of the embodiments. Accordingly, the techniques are not limited to the specific embodiments described below, but rather, include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the terms "a" and "an" mean one or more when applied to any embodiment described herein. The use of "a" and "an" does not limit the meaning to a single feature unless such a limit is specifically stated.

As used herein, the term "artificial lift" refers to the process of using artificial means within a well to increase the flow of production fluid to the surface. One common method of artificial lift involves using a mechanical device, such as a pump, within the well to drive production fluid to the surface. Another common method of artificial lift involves using a valve system, referred to as a "gas lift system," to inject pressurized gas into the well. The increased pressure from the injected gas forces accumulated production fluid to the surface.

The term "casing" refers to a protective lining for a wellbore. Any type of protective lining may be used, including those known to persons skilled in the art as liner, casing, tubing, etc. Casing may be segmented or continuous, jointed or unjointed, made of any material (such as steel, aluminum, polymers, composite materials, etc.), and may be expanded or unexpanded.

A "dual completion" is a single wellbore having tubulars and equipment that enable production from two separate zones. In most cases, dual completions include two tubing strings to provide the necessary level of control and safety for the production of fluids from both zones.

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "fluid" generally refers to liquids, even though gas or vapor phase hydrocarbons are also commonly produced with oil and liquid phase hydrocarbons. Due to the significantly higher mobility of gas through a permeable media as compared to the mobility of liquids through the same, the effects of anticipated gas association with the oil and/or water liquid fluids should also be considered when designing or preparing the technology disclosed herein. To facilitate simple explanation of the presently disclosed technology, the term fluid as used herein refers only to liquid phase fluid. This avoid adding largely redundant, excessively wordy language that really doesn't enhance the disclosure or teaching significantly. The skilled artisan will understand that in situations where gas production is anticipated to impact on the ability of the technology to convey (or prohibit or restrict) either of the liquid phase fluid through either of the porous media, consideration and accommodation should be made for any effects on effective and relative permeabilities may consider simultaneous conveyance of the gas phase in association with the respective liquid phase(s). So, unless stated otherwise, the term "fluid" as used herein, particularly with respect to permeability, refers to liquid-phase fluids.

"Formation" refers to a subsurface region including an aggregation of subsurface sedimentary, metamorphic and/or igneous matter, whether consolidated or unconsolidated, and other subsurface matter, whether in a solid, semi-solid, liquid and/or gaseous state, related to the geological development of the subsurface region. A formation can be a body of geologic strata of predominantly one type of rock or a combination of types of rock, or a fraction of strata having substantially common sets of characteristics. A formation can contain one or more hydrocarbon-bearing subterranean formations. Note that the terms "formation," "reservoir," and "interval" may be used interchangeably, but may generally be used to denote progressively smaller subsurface regions, zones, or volumes. More specifically, a "formation" may generally be the largest subsurface region, while a "reservoir" may generally be a hydrocarbon-bearing zone or interval within the geologic formation that includes a relatively high percentage of oil and gas. Moreover, an "interval" may generally be a sub-region or portion of a reservoir. In some cases, a hydrocarbon-bearing zone, or reservoir, may be separated from other hydrocarbon-bearing zones by zones of lower permeability, such as mudstones, shales, or shale-like (e.g., highly-compacted) sands.

The term "gas" is used interchangeably with a fluid in the "vapor" phase and is defined as a substance or mixture of substances in the gaseous state as distinguished from the liquid or solid states. Likewise, the term "liquid" means a substance or mixture of substances in the liquid state as distinguished from the gas or solid state.

A "hydrocarbon" is an organic compound that primarily includes the elements hydrogen and carbon, although nitrogen, sulfur, oxygen, metals, or any number of other elements may be present in small amounts. As used herein, because the present technology focuses on separating a liquid from an immiscible liquid, the term "hydrocarbon" generally refers to liquid components encountered from hydrocarbon wellbores, but doesn't necessarily exclude vaporous fluids found in natural gas, oil, or chemical processing facilities.

The term "hydrophobic" refers to a physical property of a material that seemingly repels water, while the term "oleophobic" refers to a physical property of a material that seemingly repels oil. According to embodiments described herein, an oleophobic material may interchangeably be referred to as being "hydrophilic," meaning that it seemingly attracts water.

The verb "impede," when used in reference to the flow of a non-preferred fluid phase through a media, means that the flow of the non-preferred fluid phase through the media is reduced or constrained, or less transmissible through the media, as compared to the preferred fluid phase that has a relatively higher effective permeability for the media. The term "impede" does not necessarily mean that transmissibility of the non-preferred fluid phase is entirely halted, although in some applications the result may be complete restriction of the non-preferred fluid phase.

As used herein, "production packers" or "packers" are a type of sealing mechanism used to block the flow of fluids through a well or an annulus within a well. Packers can include, for example, open-hole packers, such as swelling elastomers, mechanical packers, or external casing packers, which can provide zonal segregation and isolation.

As used herein, the term "permeability" refers to the capacity of a medium or material to allow fluids to pass through it. Permeability may be measured using Darcy's Law: $Q=(k\,\Delta P\,A)/(\mu L)$, where Q=flow rate (cubic centimeter per second ($cm^3/s$)), ΔP=pressure drop (in atmosphere (atm)) across a cylinder having a length L (centimeter (cm)) and a cross-sectional area A (squared centimeters ($cm^2$)), μ=fluid viscosity (centipoise (cp)), and k=permeability (Darcy). The customary unit of measurement for permeability is the millidarcy (mD). When the term "permeability" is used herein with reference to a formation, or an interval of a formation, it refers to the capacity of the formation to transmit fluids through the interconnected pore spaces of the rock.

The term "effective permeability," when used in reference to a media, refers to the ability of a particular type of liquid fluid phase (e.g., oil, gas or, water) to preferentially flow through that media in the presence of other liquid fluid phases. For example, effective permeability to oil is a measure of the flow capability of oil through a permeable media either in a single phase fluid system or a multiphase fluid system such as in the presence of water and/or gas, and in some cases, in the presence of both water and gas phases. The same definition of effective permeability applies for water, indicating its ability to flow through the media as a single phase (water) fluid system, or in a multiphase fluid system such as in the presence of oil or gas (or both). Effective permeability of a rock or media to fluids in a multi-fluid system is not the same as the "absolute permeability" of the rock or media. Absolute permeability reflects permeability to a 100% saturation of rock by a single fluid phase, whereas the effective permeability to a fluid phase is the permeability to that fluid phase based upon the presence of two or more other fluid phases in a porous media. Another related term of art, "relative permeability," refers to the ratio of effective permeability of a media to the absolute permeability of the media, and as it is a ratio, is typically a value between zero and one, with zero representing no permeability to the relevant fluid while 1.0 represents the situation where an absolute permeability and effective permeability to the relevant fluid are both the same. These terms of art are well known and defined in the art. Many factors affect relative and effective permeability, including pore size, capillary pressure effects due to wettability and wetting angles, fluid viscosity, pressure drop across the media, polarity/non-polarity of the media surfaces, and tortuosity of the flow path.

Even though gas phase fluids, such as hydrocarbon gases or other subterranean gases are commonly present or associated with produced reservoir fluids. The gas/vapor phase is generally readily separate by gravity separation (lower cost) and are substantially more flowable through porous median that are liquids. Thereby, the principles taught herein are considered to refer to and are applicable to liquid hydrocarbons, but may are generally do not exclude the presence of vapor-phase hydrocarbons in association with the liquid hydrocarbons. Liquid and vapor phase hydrocarbons are generally recognized as non-polar fluids and should both have affinity for non-polar surfaces in the presently disclosed fractionation technology, while polar fluids such as water generally does not include liquid hydrocarbons while perhaps permitting passage or conveyance of some vapor phase hydrocarbons. Permeability of a porous media to a gas phase is commonly on the order of hundreds of time more permeable or conductive than the same media to liquid phase fluids. Therefore, for purposes discussed herein, when reference is made herein to a hydrocarbon phase fluid, it is directed toward liquid phase fluids, but does not necessarily exclude conveyance of vapor phase hydrocarbons or fluids. Certainly, if gas phase components or cuts are known or anticipated for the produced reservoir fluid and are expected to be significant, then an accommodation or further adjustment in the permeability determinations can be made in the media conductivity needs to adjust for the presence of a vapor-phase fluid in designing either the permeable hydrophobic media, the permeable oleophobic media, or both as desired.

"Porosity" is defined as the ratio of the volume of pore space in a medium or material to the total bulk volume of the medium or material expressed in percent. Although there can be an apparent close relationship between porosity and permeability, because a highly porous medium or material may be highly permeable, there is no direct relationship between the two. A medium or material with a high percentage of porosity may be very impermeable because of the lack of communication between the individual pores, the capillary sizes of the pore space, or the morphology of the structures constituting the pore space.

The term "sand control device" refers to any elongated tubular body that permits an inflow of fluid through a slot or particulate media pack and into an inner bore or a base pipe while filtering out the unwanted sands or fines, preferably filtering out predetermined sizes of sand, fines, and granular debris from a surrounding subsurface formation. A standalone screen, such as a wire-wrapped screen or a mesh screen, is an example of a sand control device. In some cases, a gravel pack is used to augment a sand control device. The term "gravel pack" refers to gravel, sand, or other granular media or other particulate matter placed in the annulus around the sand control device to help filter out sand, fines, and granular debris from the fluid. To install a gravel pack, a particulate material, e.g., gravel, is typically delivered downhole by means of a carrier fluid. The carrier fluid with the entrained gravel is typically referred to as a "gravel slurry." The gravel slurry dries in place, leaving a circumferential packing of gravel around the sand control device. The gravel pack not only aids in particle filtration but also helps maintain wellbore integrity.

As used herein, the term "subsurface" refers to a geologic strata occurring below the earth's surface.

The term "substantially," when used in reference to a quantity or amount of a material, or a specific characteristic thereof, refers to an amount that is sufficient to provide an effect that the material or characteristic was intended to provide. The exact degree of deviation allowable may depend, in some cases, on the specific context.

As used herein, the term "surface" refers to the uppermost land surface of a land well, or the mud line of an offshore well. Moreover, as used herein, "surface" and "subsurface" are relative terms. The fact that a particular piece of equipment is described as being on the surface does not necessarily mean it has to be physically above the surface of the earth but, rather, describes only the relative placement of the surface and subsurface pieces of equipment. In that sense, the term "surface" may generally refer to any equipment that is located above the casing, production tubing, and other equipment that is located inside the wellbore.

The terms "well" and "wellbore" refer to holes drilled vertically, at least in part, and may also refer to holes drilled with deviated, highly deviated, and/or horizontal sections.

The term also includes wellhead equipment, surface casing, intermediate casing, and the like, typically associated with oil and gas wells.

As used herein, a "well completion" is a group of equipment and operations that may be installed and performed to produce hydrocarbons from a subsurface reservoir. The well completion may include the casing, production tubing, completion fluid, gas lift valves, and other equipment used to prepare the well to produce hydrocarbons.

The term "wettability" refers to the tendency of a liquid to spread on a solid surface. Wettability plays an important role in determining the interactions between the solids, e.g., the rock and other media, and the liquids, e.g., the oil and water, within a reservoir. Specifically, the wettability determines how easily a liquid moves and has a tremendous impact on what liquid is primarily produced. Rocks can be classified as water-wet, mixed-wet, or oil-wet. If a reservoir is oil-wet, the oil preferentially sticks to the rock. Therefore, more oil may generally be recovered in oil-wet reservoirs because the oil phase is continuous in the reservoir and does not get trapped. However, if a reservoir is water-wet, the water preferentially sticks to the rock and flow more readily. Therefore, less oil may generally be recovered because it can be trapped inside pores filled with water.

Overview

The present techniques relate to a downhole fractionation system and method for separating production fluid in the subsurface using the fractionation system. The fractionation system is passive, meaning that it does not require power but, rather, utilizes the pressure differential between the well and the reservoir to perform the fractionation process. In various embodiments, the fractionation system is positioned within a wellbore on a subsurface end of a production tubing and is in hydraulic communication with a production region of the wellbore. The production region is an annular area between the wellbore and the subsurface end of the production tubing, and is configured to receive a production fluid from a reservoir. According to embodiments described herein, the fractionation system includes a permeable hydrophobic media and a permeable oleophobic media that are in simultaneous hydraulic communication with each other and the production region. As the production fluid from the reservoir enters the production region, the production fluid simultaneously contacts the permeable hydrophobic media and the permeable oleophobic media. The permeable hydrophobic media preferentially conveys at least a first portion of the production fluid from the production region into the production tubing, while the permeable oleophobic media preferentially conveys at least a second portion of the production fluid from the production region into a second flow path.

In various embodiments, the presently disclosed fractionation system includes two primary permeable mediums that are simultaneously encountered in a production region of the wellbore are provided for separating the produced oil/water liquid mixture in the wellbore. One primary permeable medium is a hydrophobic media that is manufactured to preferentially provide a relatively high effective permeability to hydrocarbons (oil) and a relatively low (low as compared to the permeability to oil) effective permeability to water (but not necessarily zero permeability to water, although it may sometimes also be substantially zero permeability to water), thus providing a preferential flow path (a "first" flow path) for conveying hydrocarbon fluids (liquids), (e.g., oil, liquid condensate), through the permeable hydrophobic media while such media impedes, restricts, or perhaps effectively prevents the flow of water through the hydrophobic media. As a result, a first portion or of the production fluid from the wellbore production region has at least a portion of the water removed therefrom such that an "oil-enriched" (oil-cut or concentration) stream is conveyed or flows through the permeable hydrophobic media and into the production tubing where the same is conveyed to the surface region.

The second primary permeable medium for separating the produced oil/water liquid mixture in the wellbore includes an oleophobic media (hydrocarbon restrictive) media that is manufactured or prepared to preferentially provide a relatively high effective permeability to water and a relatively low (or preferably substantially zero) effective permeability to oil, thus providing a preferential flow path (a "second" or "another" flow path) for conveying water through the permeable oleophobic media while such media highly restricts or even prevents the flow of hydrocarbons through the media. As a result, a substantial portion or ideally all of the water portion of the produced fluid in the production region of the wellbore is removed from the hydrocarbons present in the production region, such that the separated water portion (water-enriched, or enhanced water-cut) may be conveyed and directed through another or second flow path, other than into the production tubing, for disposition such as disposal or injection into another formation of the subsurface region.

In various embodiments, the fractionation system is positioned proximate or adjacent a set of wellbore perforations (such as across from or below such perforations so gas may be gravity-separated in the wellbore annulus and produced up the wellbore annulus). The permeable hydrophobic media covers a number of perforations on the production tubing, and the oil-enriched stream flows through the permeable hydrophobic media and the perforations to enter the production tubing. In addition, the permeable oleophobic media (water-removing media) covers a fluid inlet for the second flow path (such as across, through or around a packer isolating the production region from the water-disposal region of flow path), and the water-enriched stream flows through the permeable oleophobic media and the fluid inlet to enter the second flow path.

In some embodiments, the second or another flow path may include part of an annulus of the well, and the fluid inlet is an opening between the production tubing and the production packer that leads to the annulus. In other embodiments, if the well is a dual completion, the second flow path is a second production tubing that is strung alongside the production tubing, and the fluid inlet is a number of perforations on the second production tubing. Moreover, in other embodiments, if the well is a dual concentric completion, the second flow path is a second production tubing that is concentric with the production tubing, and the fluid inlet is a number of perforations on the second production tubing. The terms oil-enriched and water-enriched merely reflect that as compared to the post fractionation or separated fluid streams having a higher content of water or oil therein, as compared to the fraction of oil or water in the produced fluid region of the wellbore prior to fractionation or separation. For purposes herein, an oil or water stream may be considered "enriched" by definition after passing through the fraction system, even though the other of the oil or water may not have been present in the produced fluid region, such as for example if only or only water is produced into the produced fluid region. In many instances, the produced fluid typically includes both oil and water phases, and often a gas phase may also be present. For purposes herein, the gas phase is considered part of the oil phase, as they are both hydrocarbon phases and are collectively herein referred to as the oil phase.

Downhole Fractionation System

FIG. 1 is a cross-sectional schematic view of a well 100 that includes an exemplary fractionation system 102. The well 100 defines a bore 104 that extends from a surface 106 into a formation 108 within the earth's subsurface. The formation 108 includes several subsurface intervals, such as a first impermeable interval 110, a low-pressure interval 112, a second impermeable interval 114, and a high-pressure interval 116. In various embodiments, the low-pressure interval 112 is a depleted reservoir, while the high-pressure interval 116 is a reservoir from which hydrocarbon fluids, such as oil and natural gas, may be produced.

The well 100 includes a well tree 118. The well tree 118 includes a shut-in valve 120 that controls the flow of production fluid from the well 100. In addition, a subsurface safety valve 122 is provided to block the flow of production fluid from the well 100 in the event of a rupture or a catastrophic event at the surface 106 or above the subsurface safety valve 122. Artificial lift equipment, such as a pump (not shown) or a gas lift system (not shown), may optionally be included in the well 100 to aid the movement of the production fluid from the high-pressure interval 116 to the surface 106.

The well 100 is completed by setting a series of tubulars into the formation 108. These tubulars include several strings of casing, such as a surface casing 124 and a production casing 126. In some embodiments, one or more intermediate casing strings (not shown) are also included to provide support for the walls of the well 100. The surface casing 124 is hung from the surface 106, while the production casing 126 (and any intermediate casings) may be hung from the surface 106, as shown in FIG. 1, or from the next higher casing string using an expandable liner or liner hanger, for example.

The surface casing 124 and the production casing 126 are set in place using cement 128. The cement 128 isolates the intervals 110-116 of the formation 108 from the well 100 and each other.

A string of production tubing 130 is provided in the bore 104. The production tubing 130 includes a surface end that is proximate to the surface 106 and a subsurface end that is proximate to the high-pressure interval 116 of the formation 108, which may be generally referred to as a "subsurface region." The production tubing 130 extends through the center of the production casing 126 and is used to transport production fluid from the high-pressure interval 116 to the surface 106. An annulus 132 is formed between the production tubing 130 and the surrounding production casing 126. A first production packer 134 and a second production packer 136 seal the annulus 132 near the lower portion of the well 100, e.g., the portion of the well 100 extending into the high-pressure interval 116. In various embodiments, the first and second production packers 134 and 136 are set through a combination of mechanical manipulation and hydraulic forces.

In addition, the lower portion of the well 100 includes a number of perforations 138 through the production tubing 130, the production casing 126, and the surrounding cement 128. The perforations 138 allow production fluid to flow into the production tubing 130. According to embodiments described herein, the portion of the well 100 extending below the production packer 134 and immediately surrounding the perforations 138 may generally be referred to as the "production region." Specifically, the production region is an annular area between the bore 104 and the production tubing 130 where production fluid from the reservoir flows into the well 100.

The production fluid within the high-pressure interval 116, or reservoir, includes some combination of oil, water, and natural gas (as well as various other components). The fraction of each component varies through time, with the fraction of water and gas typically increasing relative to the fraction of oil. Because water is an unwanted fluid, embodiments described herein provide the fractionation system 102 positioned on the subsurface end of the production tubing 130 proximate to the production region of the well 100. The fractionation system 102 separates the production fluid into a water-enriched stream 140 and an oil-enriched stream 142.

According to embodiments described herein, the fractionation system 102 includes a permeable hydrophobic media 144 and a permeable oleophobic, or hydrophilic, media 146. The permeable hydrophobic media 144 and the permeable oleophobic media 146 are in hydraulic communication with each other and the production region. Moreover, they are configured in parallel such that the production fluid contacts both media 144 and 146 simultaneously. In various embodiments, the permeable hydrophobic media 144 preferentially conveys a first portion of the production fluid from the production region into the production tubing 130, while the permeable oleophobic media 146 preferentially conveys a second portion of the production fluid from the production region into a second flow path that is hydraulically isolated from the production tubing 130. More specifically, according to the embodiment shown in FIG. 1, the permeable hydrophobic media 144 covers the perforations 138 in the production tubing 130, and is configured to allow primarily oil to pass through the perforations 138, thus producing the oil-enriched stream 142 that travels up the production tubing 130 to the surface 106. In contrast, the permeable oleophobic media 146 is positioned proximate to the first and second production packers 134 and 136, and covers a fluid inlet that allows primarily water to bypass the first and second production packers 134 and 136 and flow into the annulus 132. The resulting water-enriched stream 140 then travels up the annulus 132 and is dumped, or injected, into the low-pressure interval 112 of the formation 108 via a number of perforations 148 along the production casing 126.

The fractionation system 102 is able to efficiently separate a multi-phase fluid, e.g., the production fluid, into an oil phase and a water phase due to the difference in effective permeability between the permeable hydrophobic media 144 and the permeable oleophobic media 146. Specifically, the permeable hydrophobic media 144 is manufactured with a relatively high effective permeability to oil and a relatively low effective permeability to water. Therefore, the oil-enriched stream preferentially flows through the permeable hydrophobic media 144 into the production tubing 130 and is conveyed to the surface 106. In contrast, the permeable oleophobic media 146 is manufactured with a relatively high effective permeability to water and a relatively low effective permeability to oil. As a result, the water-enriched stream preferentially flows through the permeable oleophobic media 146 into the second flow path.

In various embodiments, the thickness, porosity, permeability, and wettability of the permeable hydrophobic media 144 and the permeable oleophobic media 146 are specifically tailored to fractionate the flow of the fluids in the subsurface. In general, a highly permeable media is not effective as a fractionation tool. Therefore, in some embodiments, the permeability of the media 144 and 146 may be relatively low, e.g., less than around 500 millidarcy (mD), but preferably around 100 mD to 200 mD. Moreover, in most cases, the permeability of the media 144 and 146 is not below 10 mD, because the media 144 and 146 may then be too tight to allow sufficient fluid flow.

In some embodiments, the thickness of the media 144 and 146 ranges from around 1 to 4 centimeters (cm), depending on the details of the specific implementation. For example, if the permeability of the media 144 or 146 is 100 mD and the grain size is 30 microns, the media 144 and 146 may be around 3 cm thick, assuming that it is 1,000 grains thick. Furthermore, in some embodiments, one media 144 or 146 may be thicker and/or more permeable than the other, depending on the oil/water ratio within the well 100. In general, the overall geometry and properties of the media 144 and 146 may be selected such that there is an even pressure drop across both media 144 and 146 during the fractionation process. This ensures that the oil-enriched stream 142 and the water-enriched stream 140 may continue to flow through the permeable hydrophobic media 144 and the permeable oleophobic media 146, respectively, rather than building up within the reservoir.

In some embodiments, the permeable hydrophobic media 144 includes a polytetrafluoroethylene (PTFE) material, or a polyurethane material that has surfaces that may have been treated or otherwise manipulated such that it is either enhanced to be substantially hydrophobic or inherently hydrophobic, while the permeable oleophobic media 146 includes a polyurethane material that is either naturally substantially oleophobic or may have been treated or otherwise manipulated such that its surfaces are substantially oleophobic. For example, the permeable hydrophobic media 144 may include a thermoplastic polyurethane (TPU) media that has been manufactured such that its thickness, porosity, permeability, and wettability control the pressure drop across the media and the flow of oil through the media, while limiting the flow of water. In addition, the permeable oleophobic media 146 may include a TPU media that has been manufactured such that its thickness, porosity, permeability, and wettability encourage the flow of water through the media, while preventing the flow of oil. Moreover, the permeable hydrophobic media 144 and the permeable oleophobic media 146 may also include any other types of materials that utilize the difference in polarity between oil and water to preferentially allow either oil or water to flow through the material. For example, in some embodiments, the permeable hydrophobic media 144 is a media that is coated with a hydrophobic resin, and the permeable oleophobic media 146 is a media that is coated with an oleophobic resin.

The hydrophobic and oleophobic properties of the permeable hydrophobic media 144 and the permeable oleophobic media 146, respectively, help to control the percentages of oil and water within the oil-enriched stream 142 and the water-enriched stream 140. In various embodiments, the oil-enriched stream 142 includes greater than 50% or, preferably, greater than 90% oil, and the water-enriched stream 140 includes greater than 50% or, preferably, greater than 90% water. It will be understood by one of skill in the art that the terms "oil-enriched stream" and "water-enriched stream" are used in a relative sense herein to refer to the enhanced percentages of oil and water, respectively, of each stream after the fractionation process.

The schematic view of FIG. 1 is not intended to indicate that the well 100 or the fractionation system 102 is to include all of the components shown in FIG. 1. For example, in some embodiments, the perforations 148 in the production casing 126 are omitted, and the water-enriched stream 140 is pumped to the surface 106 instead of being injected into the low-pressure interval 112. In those embodiments, the well 100 may include an artificial lift system (not shown) that is designed to efficiently force the water-enriched stream 140 to the surface 106. Alternatively, a dump flood completion (DFC) may be used to directly dispose of the water-enriched stream 140 in the low-pressure interval 112. Moreover, the water-enriched stream 140 may also be utilized or disposed of in any other suitable manner. In most cases, this involves utilizing or disposing of the water-enriched stream 140 within the subsurface such that the water-enriched stream 140 never reaches the surface 106.

The well 100 and the fractionation system 102 may also include any number of additional components not shown in FIG. 1, depending on the details of the specific implementation. For example, while the well 100 is depicted as a vertical well, it is to be understood that the well 100 may additionally or alternatively be described as including a well section that extends horizontally, or within a range of being vertical or horizontal, such as within 5 degrees, 10 degrees, 15 degrees, or 20 degrees of being either vertical or horizontal. In addition, while the well 100 is depicted as a cased-hole completion, it is to be understood that an open-hole completion (or any other suitable type of completion) may also be used according to embodiments described herein. Moreover, while only one fractionation system 102 is shown in FIG. 1, it is to be understood that any number of additional fractionation systems may be included in the well 100. Furthermore, in some embodiments, the portion of the water-enriched stream 140 that flows downward through the second production packer 136 may be injected into another low-pressure interval, or depleted zone, that is not shown in FIG. 1.

In various embodiments, the permeable hydrophobic media 144 and the permeable oleophobic media 146 may be replaced once they have reached the end of their useful lifetimes. For example, the production tubing 130 may be pulled out of the well 100, and the permeable hydrophobic media 144 may be unscrewed from the end of the production tubing 130. A new permeable hydrophobic media 144 may then be screwed onto the production tubing 130 before it is run back into the well 100.

In some embodiments, a demulsifier is injected into the production fluid entering the well 100. This may cause the production fluid to begin separating into the oil-enriched stream 142 and the water-enriched stream 140 before it contacts the permeable hydrophobic media 144 and the permeable oleophobic media 146. In some cases, this may significantly extend the useful lifetimes of the permeable hydrophobic media 144 and the permeable oleophobic media 146.

According to embodiments described herein, the fractionation system 102 is passive, e.g., does not require the use of a powered tool, because the pressure differential between the well 100 and the high-pressure interval 116 is sufficient to force the oil-enriched stream 142 and the water-enriched stream 140 through the permeable hydrophobic media 144 and the permeable oleophobic media 146, respectively. As a result, the fractionation system 102 may significantly reduce the operating costs for the well 100. In addition, because the fluid separation is accomplished using the material properties of the permeable hydrophobic media 144 and the permeable oleophobic media 146, the fractionation system 102 is effective even for fluids with similar densities and viscosities.

Moreover, in some embodiments, the permeable hydrophobic media 144 and the permeable oleophobic media 146 are manufactured to control the resulting pressure drop in the high-pressure interval 116. This may ultimately improve the flow conformance along the well 100 and the efficiency of the oil-water separation process.

Figure 2A:
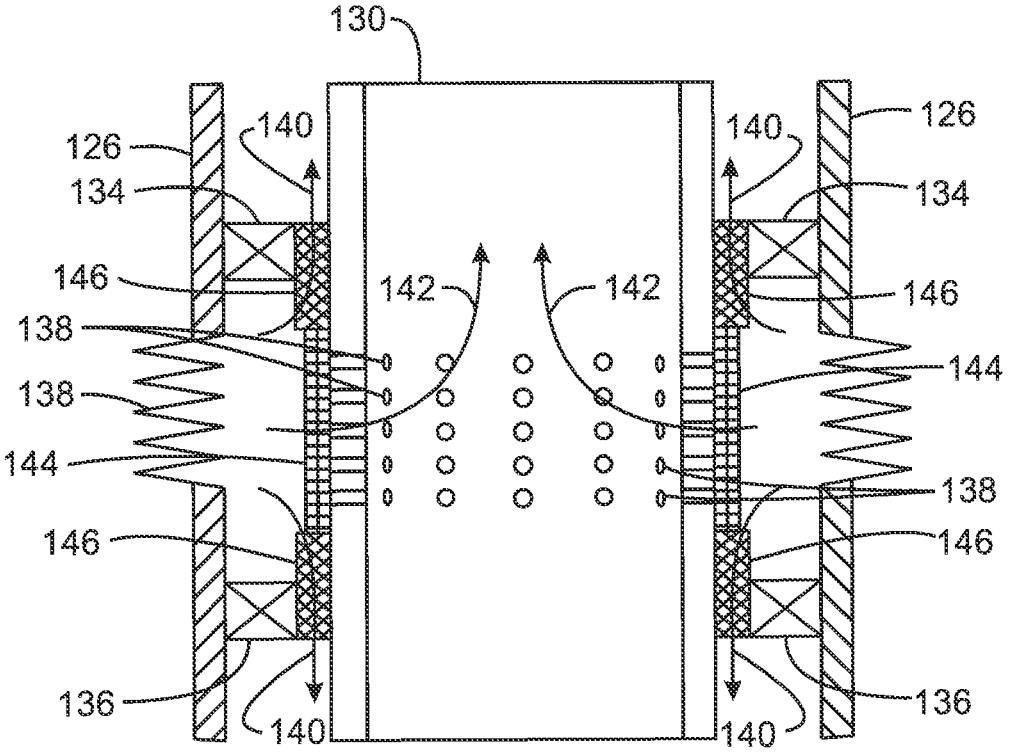
FIG. 2A is a cross-sectional schematic view of the exemplary fractionation system implemented within the vertical well of FIG. 1.
Figure 2B:
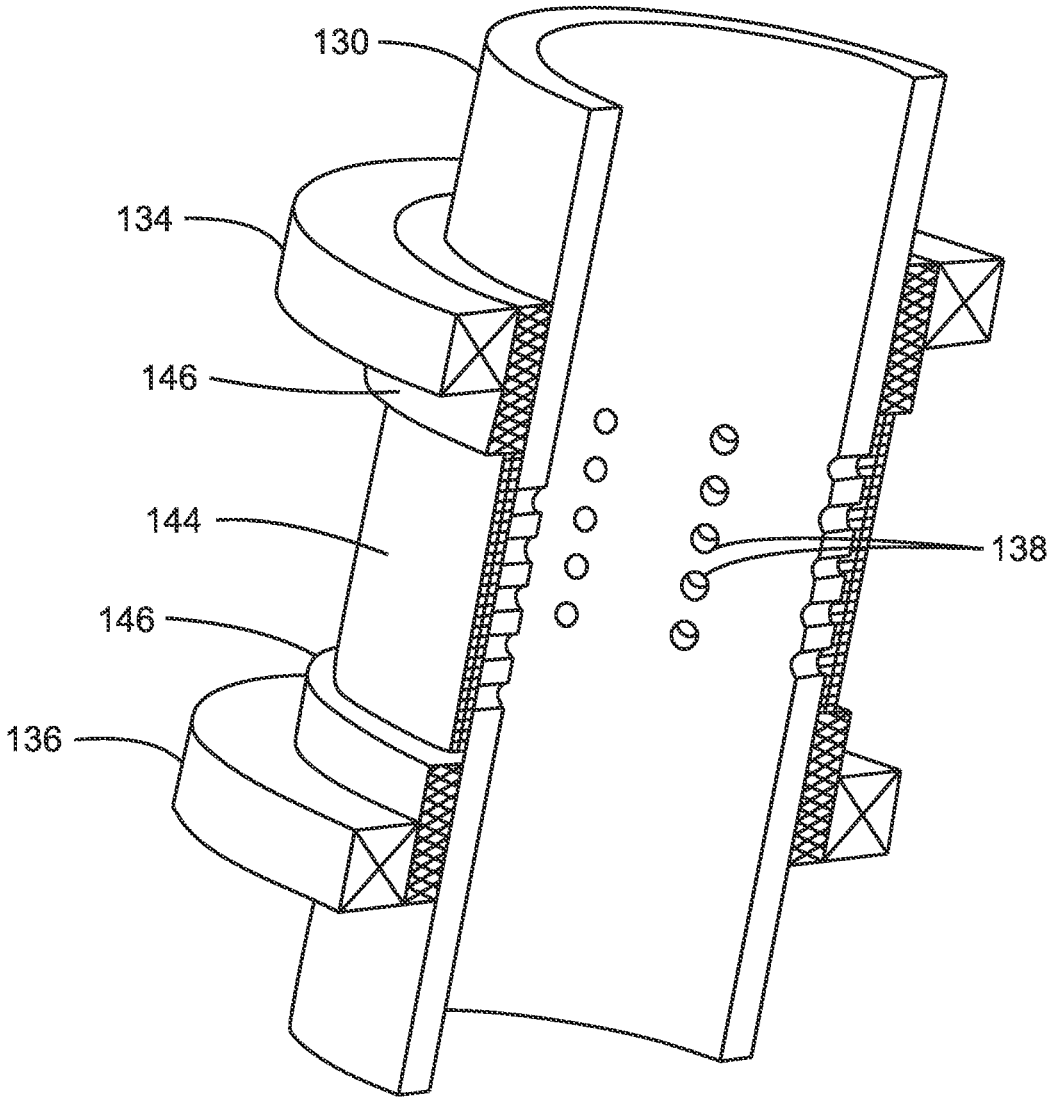
FIG. 2B is a three-dimensional cross-sectional schematic view of the exemplary fractionation system.

FIG. 2A is a cross-sectional schematic view of the exemplary fractionation system 102 implemented within the vertical well of FIG. 1. FIG. 2B is a three-dimensional cross-sectional schematic view of the exemplary fractionation system 102. Like numbered items are as described with respect to FIG. 1. As shown in FIGS. 2A and 2B, the perforations 138 extend around the circumference of the production tubing 130 in the high-pressure interval 116. Moreover, the permeable hydrophobic media 144 includes a material that is wrapped around the production tubing 130, or screwed onto the production tubing 130, such that the perforations 138 are completely covered. In this manner, the fractionation system 102 ensures that production fluid does not enter the production tubing 130 without first being filtered by the permeable hydrophobic media 144. Furthermore, as shown in FIGS. 2A and 2B, the permeable oleophobic media 146 includes a material that is wrapped around the production tubing 130, or screwed onto the production tubing 130, such that a second flow path is provided for water to bypass the first and second production packers 134 and 136 and enter the annulus 132 of the well 100.

Figure 3A:
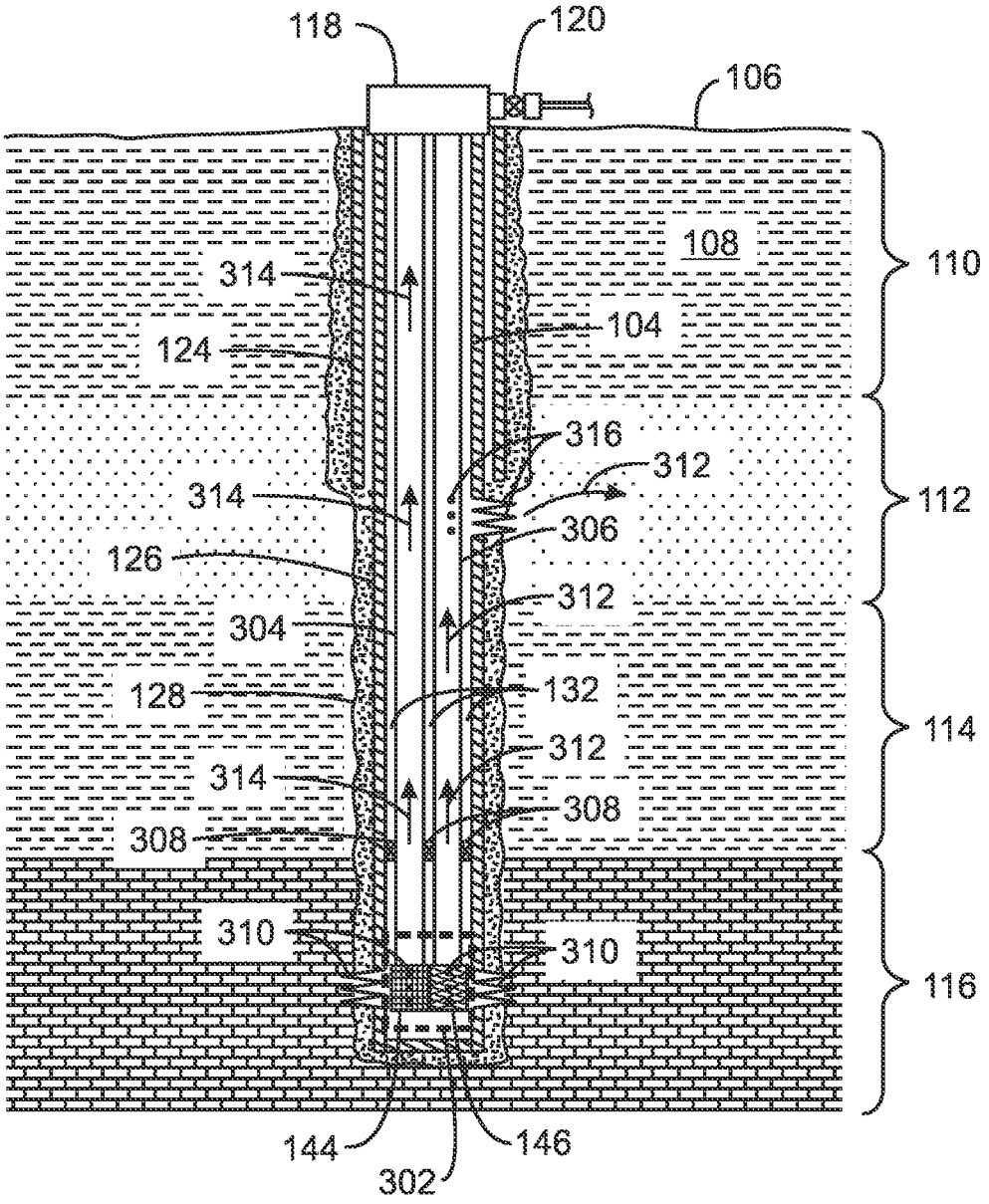
FIG. 3A is a cross-sectional schematic view of a dual-completion well that includes an exemplary fractionation system.

FIG. 3A is a cross-sectional schematic view of a dual-completion well 300 that includes an exemplary fractionation system 302. Like numbered items are as described with respect to FIGS. 1, 2A, and 2B. The dual-completion well 300 is similar to the well 100 of FIG. 1. However, the dual-completion well 300 includes two strings of production tubing, a first production tubing 304 and a second production tubing 306. The first production tubing 304 and the second production tubing 306 both extend through the center of the production casing 126, such that the annulus 132 is formed between the first production tubing 304, the second production tubing 306, and the surrounding production casing 126. Furthermore, a production packer 308 seals the annulus 132 near the lower portion of the well 100. In various embodiments, the production packer 308 is coupled to the walls of the production casing 126, the first production tubing 304, and the second production tubing 306 through a combination of mechanical manipulation and hydraulic forces.

The lower portion of the well 100 includes a number of perforations 310 through the first production tubing 304, the second production tubing 306, the production casing 126, and the surrounding cement 128. The perforations 310 allow production fluid from the high-pressure interval 116 to flow into the production region surrounding the first production tubing 304 and the second production tubing 306 in the portion of the well 100 extending below the production packer 308.

The fractionation system 302 is then used to separate the production fluid into a water-enriched stream 312 and an oil-enriched stream 314. According to the embodiment shown in FIG. 3A, the fractionation system 302 includes the permeable hydrophobic media 144 and the permeable oleophobic media 146. The permeable hydrophobic media 144 covers the perforations 310 in the first production tubing 304, and the permeable oleophobic media 146 covers the perforations 310 in the second production tubing 306. As a result, the oil within the production region flows through the permeable hydrophobic media 144 and into the first production tubing 304, producing the oil-enriched stream 314 that flows up the first production tubing 304 to the surface 106. In addition, the water within the production region flows through the permeable oleophobic media 146 and into the second production tubing 306, producing the water-enriched stream 312. The water-enriched stream 312 then flows up the second production tubing 306 and is dumped, or injected, into the low-pressure interval 112 of the formation 108 via a number of perforations 316 along the second production tubing 306.

Figure 3B:
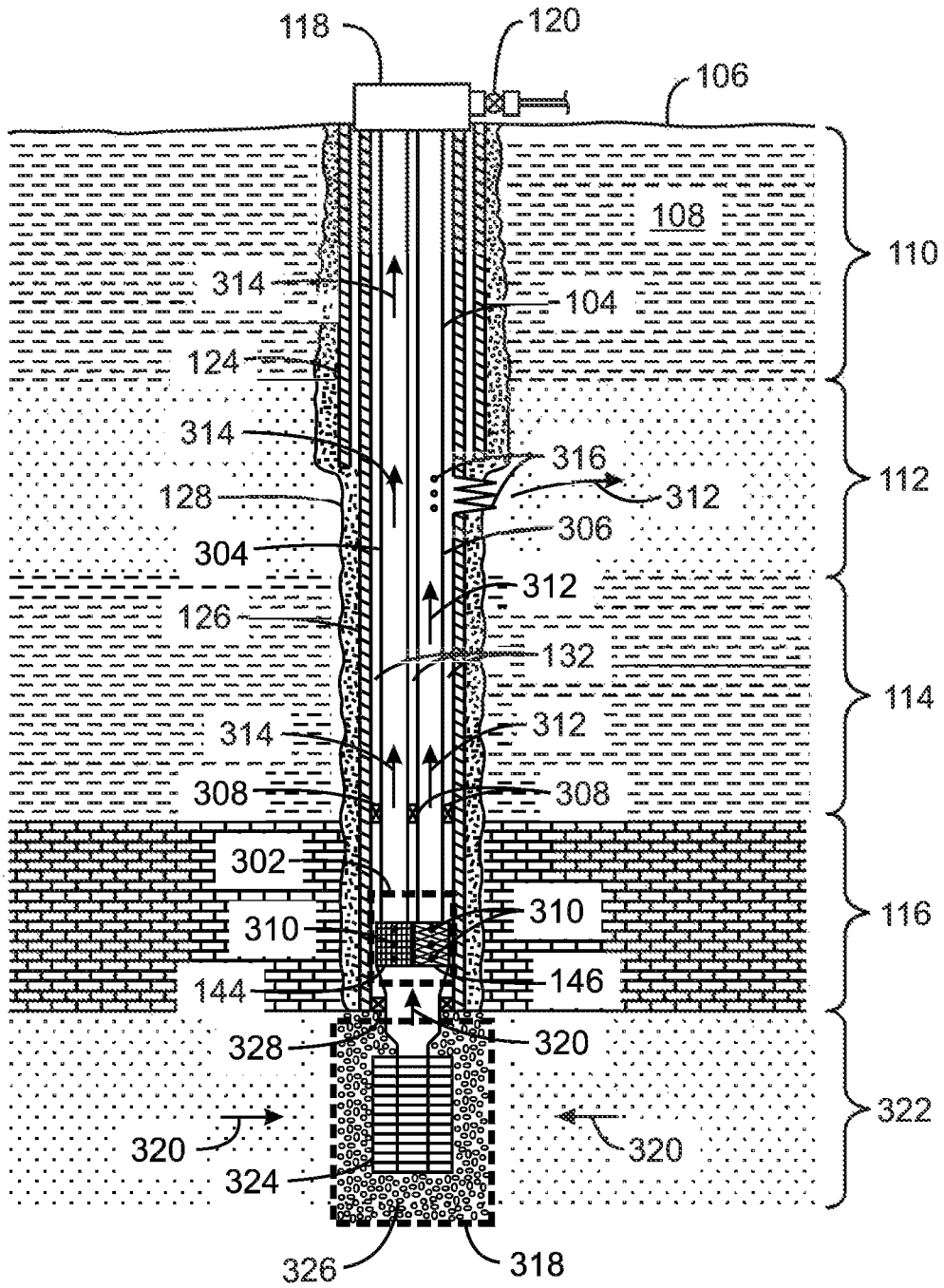
FIG. 3B is a cross-sectional schematic view of the dual-completion well of FIG. 3A with the addition of a sand control device.

FIG. 3B is a cross-sectional schematic view of the dual-completion well 300 of FIG. 3A with the addition of a sand control device 318. Like numbered items are as described with respect to FIGS. 1, 2A, 2B, and 3A. In various embodiments, the schematic view of FIG. 3B shows a modification of the dual-completion well 300 of FIG. 3A for instances where sand control is desirable. Specifically, a sand control device 318 is provided below the fractionation system 302, and is used to filter out predetermined sizes of sand, fines, and granular debris from a production fluid 320 flowing into the well 100 from a second low-pressure interval 322 located below the high-pressure interval 116.

According to the embodiment shown in FIG. 3B, the sand control device 318 includes both a stand-alone screen 324 and a gravel pack 326. However, in other embodiments, the stand-alone screen 324 may be used without the gravel pack 326, or vice versa.

A second production packer 328 is also provided immediately above the sand control device 318 to seal the lower portion of the well 100. The production fluid 320 that is filtered by the sand control device 318 travels through an opening in the second production packer 328 to reach the production region surrounding the first production tubing 304 and the second production tubing 306. The fractionation system 302 is then used to separate the production fluid 320 into the oil-enriched stream 314 and the water-enriched stream 312, as described with respect to FIG. 3A.

Figure 4:
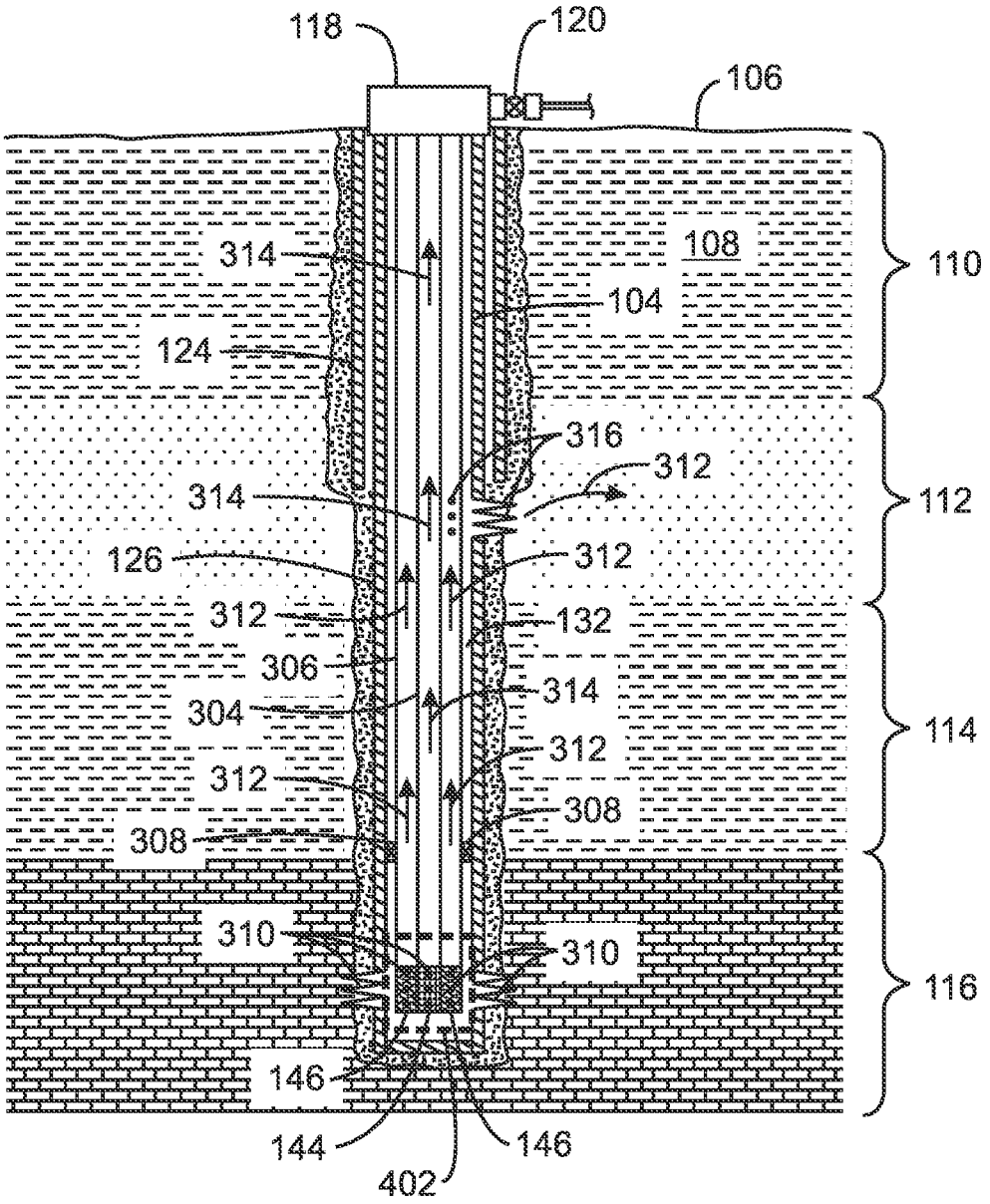
FIG. 4 is a cross-sectional schematic view of a dual-concentric-completion well that includes an exemplary fractionation system.

FIG. 4 is a cross-sectional schematic view of a dual-concentric-completion well 400 that includes an exemplary fractionation system 402. Like numbered items are as described with respect to FIGS. 1, 2A, 2B, 3A, and 3B. The dual-concentric-completion well 400 of FIG. 4 is the same as the dual-completion well 300 of FIG. 3A, except the second production tubing 306 surrounds the first production tubing 304. Therefore, the first production tubing 304 and the second production tubing 306 are coaxial, or concentric.

The fractionation system 402 of FIG. 4 also functions in the same manner as the fractionation system 302 of FIGS. 3A and 3B. Specifically, the permeable hydrophobic media 144 ensures that the oil-enriched stream 314 enters the first production tubing 304, while the permeable oleophobic media 146 ensures that the water-enriched stream 312 enters the second production tubing 306.

Figure 5:
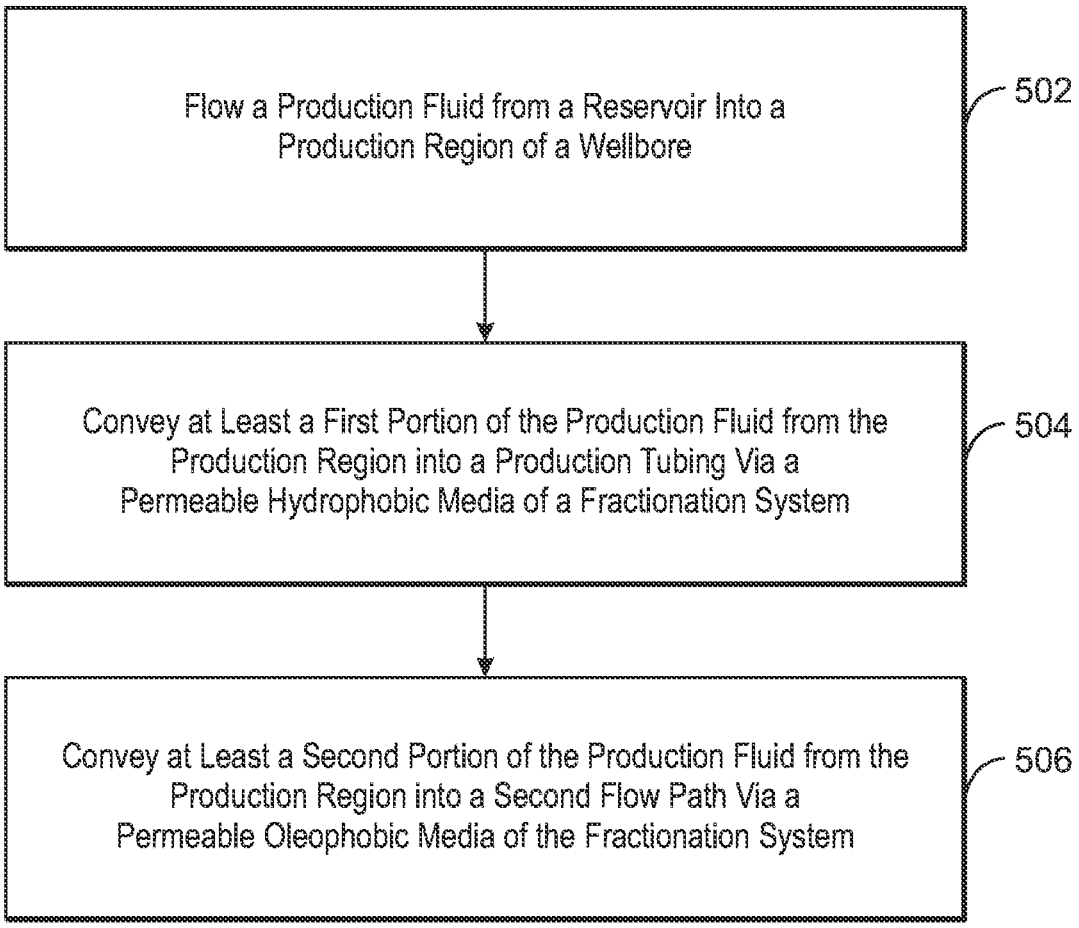
FIG. 5 is a process flow diagram of a method for separating production fluid in the subsurface using a fractionation system.

Methods for Separating Production Fluid in the Subsurface Using a Fractionation system FIG. 5 is a process flow diagram of a method 500 for separating production fluid in the subsurface using a fractionation system within a wellbore. In various embodiments, the fractionation system includes one of the fractionation systems 102, 302, or 402 described with respect to FIG. 1, 2A, 2B, 3A, 3B, or 4, respectively. The fractionation system is disposed within a wellbore on a subsurface end of a production tubing proximate to a production region of the wellbore. Moreover, the fractionation system includes a permeable hydrophobic media and a permeable oleophobic media that are in simultaneous hydraulic communication with the production region.

The method 500 begins at block 502, at which a production fluid is flowed from a reservoir into the production region of the wellbore. At block 504, at least a first portion of the production fluid is conveyed from the production region into the production tubing via the permeable hydrophobic media of the fractionation system. In various embodiments, the permeable hydrophobic media is manufactured with a relatively high effective permeability to oil (and a relatively low effective permeability to water), thus providing a preferential flow path for flowing hydrocarbon fluids, e.g., oil, through the permeable hydrophobic media while impeding the flow of water through the media. As a result, the first portion of the production fluid includes an oil-enriched stream that flows through the permeable hydrophobic media into the production tubing and is conveyed to a surface region of the wellbore.

At block 506, at least a second portion of the production fluid is conveyed from the production region into a second flow path via the permeable oleophobic media of the fractionation system. In various embodiments, the permeable oleophobic media is manufactured to provide a relatively high effective permeability to water (and a relatively low effective permeability to oil), thus providing a preferential flow path for flowing water through the permeable oleophobic media while impeding the flow of oil through the media. As a result, the second portion of the production fluid includes a water-enriched stream that flows through the permeable oleophobic media into the second flow path for disposing of the water-enriched stream. In some embodiments, the water-enriched stream is injected into another subsurface region of the wellbore via the second flow path. In other embodiments, the water-enriched stream is conveyed to a surface region via the second flow path.

The second flow path may include any suitable means for disposing of the water-enriched stream. For example, the second flow path may be an annulus between the production tubing and a production casing. A production packer may seal the annulus proximate the subsurface end of the production tubing, and the second flow path may allow the water-enriched stream to bypass the production packer to enter the annulus of the well completion. As another example, the well completion may be a dual completion, and the second flow path may be a second production tubing that is strung alongside the production tubing. Moreover, as another example, the well completion may be a dual concentric completion, and the second flow path may be a second production tubing that is concentric with the production tubing.

In various embodiments, the thickness, porosity, permeability, and wettability of the permeable hydrophobic media and the permeable oleophobic media are specifically tailored to separate the production fluid into the oil-enriched stream and the water-enriched stream within the subsurface. Moreover, in some embodiments, the permeable hydrophobic media includes at least one of a polytetrafluoroethylene (PTFE) material or a polyurethane material that has been manipulated such that it is substantially hydrophobic, and the permeable oleophobic media includes a polyurethane material that has been manipulated such that it is substantially oleophobic.

The process flow diagram of FIG. 5 is not intended to indicate that the steps of the method 500 are to be executed in any particular order, or that all of the steps of the method 500 are to be included in every case. Further, any number of additional steps not shown in FIG. 5 may be included within the method 500, depending on the details of the specific implementation. For example, in some embodiments, the permeable hydrophobic media and the permeable oleophobic media may be periodically replaced.

Some embodiments of the presently disclosed, improved technology includes a method for producing fluids from a wellbore, the method comprising: positioning a production tubing within a wellbore, the production tubing having a surface end proximate a surface location and a subsurface end proximate a subsurface region; producing a wellbore fluid into a production region in the wellbore, the production region including an annular area between the wellbore and the production tubing, the production region for receiving therein a production fluid from the subsurface region, the production fluid comprising oil and water; and providing a fractionation system within the wellbore on a subsurface end of the production tubing and in hydraulic communication with the production region, and flowing at least a portion of the produced fluid from the production region through the fractionation system.

Another exemplary fractionation system may include (a) a permeable hydrophobic media comprising (i) an effective permeability to oil through the permeable hydrophobic media that conveys at least an oil-enriched portion of the production fluid from the production region along a first flow path conveying oil from the production region, through the permeable hydrophobic media, and into the production tubing, and (ii) simultaneously an effective permeability to water through the permeable hydrophobic media that impedes conveyance of water from the wellbore region through the permeable hydrophobic media; and (b) a permeable oleophobic media comprising (i) an effective permeability to water through the permeable oleophobic media that conveys at least a water-enriched portion of the production fluid from the production region through the permeable oleophobic media to a second flow path for water disposal hydraulically isolated from the first flow path, the permeable oleophobic media conveying water from the permeable oleophobic media to another subsurface region of the wellbore for disposal of the conveyed water, and (ii) simultaneously the permeable oleophobic region includes an effective permeability to oil through the permeable oleophobic media that impedes conveyance of oil from the production region through the permeable oleophobic region relative to conveying water through the permeable oleophobic media.

Another exemplary method for producing fluid from a subsurface region using a wellbore comprises positioning a production tubing within a wellbore, the production tubing having a surface end proximate a surface location and a subsurface end proximate a subsurface region. The wellbore fluid flows from the subsurface formation, such as via perforations, ICDs, or and/or other openings in the wellbore wall, and into a production region in the wellbore. The production region may be a wellbore annulus between the tubing and wellbore, and may axially be defined along the wellbore axis by one or more production packers. The production region is defined or located hydraulically intermediate or between the subsurface region and the production tubing or in some instances it may also include the area in the wellbore below the tubing.

The wellbore fluid typically comprises an immiscible combination of a hydrocarbon phase and a water phase. The hydrocarbon phase of most applicability to the present technology is oil or liquid condensates, however a hydrocarbon gas phase may also be present. The water phase is often present in produces wellbore fluids, in various percentages or "cuts," referred to as the "oil cut" or "water cut." The fraction system according to the present technology may provide some downhole separation so the amount of water "lifted" or pumped to the surface is reduced, thereby reducing lifting volumes and costs. The presently described fractionation system is typically provide along the tubing string, generally across from the perforations or openings in the wellbore wall or slightly below or above the perforations or openings. The fractionation system may be considered part of the tubing string, as a throughbore of the fractionation system may hydraulically convey the separated fluid to the production tubing throughbore.

The fractionation system may separate at least a portion of the hydrocarbon phase from a portion of the water phase by at least the steps of: (a) preferentially conveying at least a portion of the hydrocarbon phase from the production region in the wellbore along a first hydraulic flow path through a permeable hydrophobic media and into the production tubing while inhibiting flow of the water phase along the first hydraulic flow path to the production tubing. The term "preferentially conveying" means favorably advocating flow or conveyance of the hydrocarbon phase through the hydrophobic media as compared to ability of the hydrophobic media to flow or convey water through the hydrophobic media. Stated differently, the relative permeability (as that term is well known and understood in the art, as the ratio of the effective permeability to a fluid in a multiphase fluid system with respect to the absolute permeability thereof, resulting in a value between and inclusive of 0 to 1) of the hydrophobic media to the hydrocarbon phase is greater than the relative permeability of the hydrophobic media to water. Hydrocarbons are generally non-polar fluids and a low surface energy or nonpolar-favoring surface on the hydrophobic media may provide such result. The higher the relative permeability to oil, the easier the hydrocarbon phase may pass through. The lower the relative permeability to water, the more effectively the water phase may be excluded or prohibited from flowing through. However, to assure that substantially all of the hydrocarbon phase is conveyed through the hydrophobic media, it may be desirable or permissible to permit at least some percentage of the water phase to also pass, so no hydrocarbons are left behind or disposed of with the separated water phase. Those skilled in the art will understand how to adjust the relative permeability, based upon the factors that affect fluid flow through porous media, such as media structure, fluid properties, pressures, media absolute permeability, etc. However, there may be operational applications such as where fluid lifting capabilities are maximized and it is desirable to achieve as much separation as possible between the hydrocarbons and water phases in the wellbore, to where substantially no water is desired into the production tubing, even if a small cut of the hydrocarbon phase is not recovered but is disposed with the water. The point is, the effective permeability of each media type, to each of the hydrocarbon and water can be tailored to fit the desired production objectives. Thereby, the hydraulic flow path along the permeable hydrophobic media includes (i) an effective permeability to the hydrocarbon phase fluid in the production region, and (ii) simultaneously, a relatively lower effective permeability to the water phase fluid in the production region relative to the effective permeability to the hydrocarbon phase fluid. That is, the permeable hydrophobic media provides a larger relative permeability to oil than to water.

Continuing the example from above, the fractionation system further may separate at least a portion of the hydrocarbon phase from a portion of the water phase also by at least the steps of: (b) preferentially conveying at least a portion of the water phase from the production region along another hydraulic flow path through a permeable oleophobic media to another region within the wellbore for water disposition (e.g., disposal or injection pressure support in another formation), while restricting conveyance of the hydrocarbon phase along the another hydraulic flow path. Note that with respect to the permeable hydrophobic media discussed in the previous paragraphs, in many embodiments it's desired to have an effective relative permeability to hydrocarbons, and also at times permit some lesser conveyance of a portion of the water phase. That was to prevent loss of any hydrocarbons in the water disposal stream. However, with respect to the permeable oleophobic media, it is most likely often preferred that no oil be permitted conveyance therethrough. The hydrocarbon phase is highly restricted or wholly restricted from passing through the permeable oleophobic media. Stated differently, the relative permeability of the oleophobic media to hydrocarbon phase fluids is preferably substantially zero. Thereby, only water is separated from the production region fluids and through the oleophobic media, whereby a disposition operation can be performed for the separated water, such as disposal of the water into another subterranean zone.

The "another" hydraulic flow path along the permeable oleophobic media is hydraulically isolated from the first flow path through the permeable hydrophobic media, such as by use of packers or another hydraulic isolation device in the wellbore. The permeable oleophobic media includes (i) an effective permeability to the water phase fluid from the production region, and (ii) simultaneously, a restricted effective permeability to the hydrocarbon phase fluid from the production region relative to the effective permeability to the water phase fluid ("restricted" meaning preferably substantially zero effective permeability to liquid hydrocarbons). Stated differently, the permeable oleophobic media provides substantial effective permeability to water and a "restricted effective permeability" to the hydrocarbon phase fluid whereby substantially no relative permeability to a hydrocarbon phase is present, whereby no hydrocarbons are lost to disposition with the separated water phase.

To recap, the combination of (a) and (b) above provide a dual-media fractionation system that separately conveys into the production tubing via one of the media (a) at least one of a hydrocarbon fluid (meaning only hydrocarbons are conveyed through the) or a hydrocarbon-enriched fluid cut, (enriched meaning increased, with respect to the hydrocarbon cut in the production region in the wellbore) via the hydrophobic media. Some produced water may or may not be present with the hydrocarbon fluids conveyed through the permeable hydrophobic media into the production tubing to avoid over-cutting oil from the system. If water is present the permeable oleophobic media may separate for disposition at least a portion of the produced water cut from the production region. In some installations, the other media (b) of the dual-media fraction system conveys along another flow path, permeable oleophobic media may separate for disposition all or substantially all of the produced water from the production region into the fluid stream for water, hydraulically isolated from the permeable hydrophobic media stream. It is likely preferred that no hydrocarbons are allowed to slip through the permeable oleophobic media stream with the separated water to avoid loss thereof, in contrast to the permeable hydrophobic media which may (but not necessarily required) permissibly allow a reduced water phase content to commingle with the hydrocarbon phase passing through the permeable hydrophobic media and into the production tubing. The likelihood of perfect oil/water separation in the wellbore by the fractionation system is difficult to achieve. But the system can be designed in a manner that accommodates a targeted and acceptable performance window that fits the most likely production scenario (e.g., water and oil cuts) anticipated from the subterranean reservoir over the useful life of the fractionation separation system.

In various embodiments, providing the lower effective permeability to the water phase fluid from the production region relative to the effective permeability to the hydrocarbon phase fluid comprises providing the hydrophobic media an effective permeability to the water phase fluid that conveys a portion of the water phase fluid from the production region into the production tubing, while simultaneously at least a portion of the water phase fluid from the production region is conveyed along the another hydraulic flow path through the permeable oleophobic media to another region within the wellbore for separated water collection.

In some embodiments, the permeable hydrophobic media may provide a lower effective permeability to the water phase fluid from the production region relative to the effective permeability to the hydrocarbon phase fluid. The "lower effective permeability" of the hydrophobic media means that the effective permeability of the hydrophobic media may (i) completely prohibit (prevent) conveyance of the water phase fluid through the hydrophobic media, or (ii) provide an effective permeability to water that is merely impedes the flow of water through the hydrophobic media more than the hydrophobic media impedes the flow of oil therethrough, such that flow to oil is greatly favored with respect to flow of water. Stated differently, the relative permeability to oil through the hydrophobic media is much higher than a relative permeability water, while the relative permeability to water is highly constricted but still at a value that is greater than substantially zero.

Similarly, in some embodiments, the restricted effective permeability of the permeable oleophobic media to the hydrocarbon phase fluid from the production region relative to the effective permeability to the water phase fluid comprises providing the permeable oleophobic media with an effective permeability to the hydrocarbon phase fluid that either (i) may completely prohibit (prevents) conveyance of the hydrocarbon phase fluid from the production region through the permeable oleophobic media (e.g., substantially zero relative permeability to liquid hydrocarbons), or (ii) may provide an effective permeability to liquid hydrocarbons that impedes the flow of hydrocarbons through the oleophobic media far more than the oleophobic media impedes the flow of water therethrough, such that flow to water through the oleophobic media is greatly favored with respect to flow of oil therethrough. Stated differently, in many embodiments the relative permeability to oil through the oleophobic media should be either prevented or greatly minimized, recognizing that in some embodiments such as where need may exist to dispose of a relatively high volume of water, there may be accommodation that some minor cut of oil is allowed to slip through the oleophobic media on the path to disposal with the separated water.

In various aspects, the lower effective permeability to the water phase fluid from the production region relative to the effective permeability to the hydrocarbon phase fluid comprises providing the permeable hydrophobic media with an effective permeability to the water phase fluid that is not greater than one-half (50%), or not greater than one quarter (25%), or not greater than one tenth (10%), or not greater than two one-hundredths (2%), of the effective permeability of the permeable hydrophobic media to the hydrocarbon phase fluids such that the permeable hydrophobic media permits conveyance of a portion of the water phase fluid from the production region into the production tubing while simultaneously at least a portion of the water phase fluid from the production region is conveyed along the another hydraulic flow path through the permeable oleophobic media to another region within the wellbore for separated water collection. In some various aspects, the permeable hydrophobic media is provided with an effective permeability of substantially zero or no conveyance to the water phase fluid. In some various aspects, the permeable hydrophobic media is provided with an effective permeability to the water phase fluid that is at least two one-hundredths (2%), or at least five one-hundredths, or at least ten percent (10%) of the effective permeability of the permeable hydrophobic media to the hydrocarbon phase fluids, but not greater than one-half (50%), or not greater than one quarter (25%), or not greater than one tenth (10%), or not greater than two one-hundredths (2%), and permissible combinations thereof, of the effective permeability of the permeable hydrophobic media to the hydrocarbon phase fluids.

In various aspects, the restrictive effective permeability of the permeable oleophobic media to the hydrocarbon phase fluid from the production region relative to the effective permeability to the water phase fluid comprises providing the permeable oleophobic media with an effective permeability to the hydrocarbon phase fluid that is at least one-one-hundredth, or at least two-hundredths (2%), or at least five hundredths (5%), but not greater than one-tenth (10%), or not greater than (5%), and permissible combinations thereof, of the effective permeability of the permeable oleophobic media to the water phase fluid such that the permeable oleophobic media restricts conveyance of the hydrocarbon phase fluid from the production region through the permeable oleophobic media. In some aspects, the restrictive effective permeability of the permeable oleophobic media to the hydrocarbon phase fluid from the production region relative to the effective permeability to the water phase fluid comprises providing the permeable oleophobic media with zero effective permeability (no conveyance) to the hydrocarbon phase fluid such that the permeable oleophobic media prevents conveyance of the hydrocarbon phase fluid from the production region through the permeable oleophobic media.

Packers may be placed in the annulus to hydraulically isolate fluids conveyed through the first flow path (hydrophobic media flow path) from fluids conveyed through the second flow path (another flow path, or oleophobic media flow path). The second flow path, another flow path through the oleophobic media may be through or bypassing around a packer or packers. Pumps may be positioned in the wellbore on the production tubing string to inject the separated water received from the second or another flow path into another subterranean formation for disposition of thereof. Some wells may have sufficient reservoir pressure to flow and naturally convey the produced fluids from the production region through the permeable media(s) while other wells may require artificial lift for either production lift and/or disposal injection of separated water, in order to influence sufficient pressure drop across the permeable media(s) to accomplish on-going production fractionation (separation) using the presently taught technology. Exemplary pumps for either or both of disposal or the separated water in the wellbore and/or for lifting the enriched oil cut from the production tubing may be an electrical submersible pump, rod pump, inverted rod pump, Piezo electric pump, or progressive cavity pump.

In one or more embodiments, the present techniques may be susceptible to various modifications and alternative forms, such as the following embodiments as noted in paragraphs 1 to 51:

1. A well completion, comprising: a wellbore comprising a production tubing positioned within the wellbore, the production tubing having a surface end proximate a surface region and a subsurface end proximate a subsurface region, the production tubing conveying a portion of a production fluid from the subsurface region to the surface region; a fractionation system positioned within the wellbore on the subsurface end of the production tubing proximate to a production region of the wellbore, the fractionation system comprising: a permeable hydrophobic media for preferentially conveying at least the first portion of the production fluid from the production region into the production tubing; and a permeable oleophobic media for preferentially conveying at least a second portion of the production fluid from the production region into a second flow path; wherein the permeable hydrophobic media and the permeable oleophobic media are in simultaneous hydraulic communication with the production region; wherein the permeable hydrophobic media is manufactured to provide a relatively high effective permeability to oil, whereby the first portion of the production fluid comprises an oil-enriched stream that flows through the permeable hydrophobic media into the production tubing and is conveyed to the surface region; and wherein the permeable oleophobic media is manufactured to provide a relatively high effective permeability to water, whereby the second portion of the production fluid comprises a water-enriched stream that flows through the permeable oleophobic media into the second flow path for disposing of the water-enriched stream.
2. The well completion of paragraph 1, wherein the water-enriched stream is injected into another subsurface region of the wellbore via the second flow path.
3. The well completion of paragraph 1, wherein the water-enriched stream is conveyed to the surface region via the second flow path.
4. The well completion of any of paragraphs 1 to 3, wherein the permeable hydrophobic media covers a plurality of perforations on the subsurface end of the production tubing, and wherein the oil-enriched stream flows through the permeable hydrophobic media and into the production tubing via the plurality of perforations.
5. The well completion of any of paragraphs 1 to 4, wherein the permeable oleophobic media covers a fluid inlet for the second flow path, and wherein the water-enriched stream flows through the permeable oleophobic media and into the second flow path via the fluid inlet.
6. The well completion of any of paragraphs 1 to 5, wherein a thickness, porosity, a permeability, and a wettability of the permeable hydrophobic media and the permeable oleophobic media are specifically tailored to separate the production fluid into the oil-enriched stream and the water-enriched stream.
7. The well completion of any of paragraphs 1 to 6, wherein the permeable hydrophobic media comprises at least one of a polytetrafluoroethylene (PTFE) material or a polyurethane material that has been manipulated such that it is substantially hydrophobic.
8. The well completion of any of paragraphs 1 to 7, wherein the permeable oleophobic media comprises a polyurethane material that has been manipulated such that it is substantially oleophobic.
9. The well completion of any of paragraphs 1 to 8, wherein the second flow path comprises an annulus between the production tubing and a production casing.
10. The well completion of paragraph 9, comprising a production packer for sealing the annulus proximate the subsurface end of the production tubing, wherein the second flow path allows the water-enriched stream to bypass the production packer to enter the annulus of the well completion.
11. The well completion of any of paragraphs 1 to 8, wherein the well completion comprises a dual completion, and wherein the second flow path comprises a second production tubing that is strung alongside the production tubing.
12. The well completion of any of paragraphs 1 to 8, wherein the well completion comprises a dual concentric completion, and wherein the second flow path comprises a second production tubing that is concentric with the production tubing.
13. The well completion of any of paragraphs 1 to 12, wherein the fractionation system is configured such that the permeable hydrophobic media and the permeable oleophobic media can be periodically replaced.
14. A method for separating production fluid in a subsurface region within a wellbore, comprising: flowing a production fluid from a reservoir into a production region of a wellbore, wherein the production region is located within a subsurface region of the wellbore that is proximate to a subsurface end of a production tubing positioned within the wellbore; conveying at least a first portion of the production fluid from the production region into the production tubing via a fractionation system, wherein the fractionation system is positioned within the wellbore on the subsurface end of the production tubing, wherein the fractionation system comprises a permeable hydrophobic media and a permeable oleophobic media that are in simultaneous hydraulic communication with the production region, and wherein the permeable hydrophobic media is manufactured to provide a relatively high effective permeability to oil, whereby the first portion of the production fluid comprises an oil-enriched stream that flows through the permeable hydrophobic media into the production tubing and is conveyed to a surface region of the wellbore; and conveying at least a second portion of the production fluid from the production region into a second flow path via the fractionation system, wherein the permeable oleophobic media is manufactured to provide a relatively high effective permeability to water, whereby the second portion of the production fluid comprises a water-enriched stream that flows through the permeable oleophobic media into the second flow path for disposing of the water-enriched stream.
15. The method of paragraph 14, comprising injecting the water-enriched stream into another subsurface region of the wellbore via the second flow path.
16. The method of paragraph 14, comprising conveying the water-enriched stream to the surface region via the second flow path.
17. The method of any of paragraphs 14 to 16, wherein a thickness, a porosity, a permeability, and a wettability of the permeable hydrophobic media and the permeable oleophobic media are specifically tailored to separate the production fluid into the oil-enriched stream and the water-enriched stream within the subsurface.
18. The method of any of paragraphs 14 to 17, wherein the permeable hydrophobic media comprises at least one of a polytetrafluoroethylene (PTFE) material or a polyurethane material that has been manipulated such that it is substantially hydrophobic.

19. The method of any of paragraphs 14 to 18, wherein the permeable oleophobic media comprises a polyurethane material that has been manipulated such that it is substantially oleophobic.
20. The method of any of paragraphs 14 to 19, wherein disposing of the water-enriched stream via the second flow path comprises flowing the water-enriched stream into an annulus of the well between the production tubing and a production casing.
21. The method of paragraph 20, comprising: sealing the annulus proximate the subsurface end of the production tubing via a production packer; and allowing the water-enriched stream to bypass the production packer to flow into the annulus.
22. The method of any of paragraphs 14 to 19, wherein the well comprises a dual-completion well, and wherein disposing of the water-enriched stream via the second flow path comprises flowing the water-enriched stream into a second production tubing that is strung alongside the production tubing.
23. The method of any of paragraphs 14 to 19, wherein the well comprises a dual-concentric-completion well, and wherein disposing of the water-enriched stream via the second flow path comprises flowing the water-enriched stream into a second production tubing that is concentric with the production tubing.
24. A fractionation system, comprising: a permeable hydrophobic media; and a permeable oleophobic media; wherein the permeable hydrophobic media and the permeable oleophobic media are in simultaneous hydraulic communication with a fluid comprising oil and water; wherein the permeable hydrophobic media is manufactured to provide a relatively high effective permeability to oil, whereby an oil-enriched stream flows through the permeable hydrophobic media into a first flow path; and wherein the permeable oleophobic media is manufactured to provide a relatively high effective permeability to water, whereby a water-enriched stream flows through the permeable oleophobic media into a second flow path.
25. The fractionation system of paragraph 24, wherein the fractionation system is implemented within a wellbore; the fluid comprises a production fluid; and the fractionation system is used to separate the production fluid into the oil-enriched stream and the water-enriched stream within a subsurface region of the wellbore.
26. The fractionation system of paragraph 25, wherein the fractionation system is positioned within the wellbore on a subsurface end of a production tubing, and wherein the first flow path comprises the production tubing for conveying the oil-enriched stream to a surface region of the wellbore.
27. The fractionation system of any of paragraphs 24 to 26, wherein a thickness, a porosity, a permeability, and a wettability of the permeable hydrophobic media and the permeable oleophobic media are specifically tailored to separate the fluid into the oil-enriched stream and the water-enriched stream.
28. The fractionation system of any of paragraphs 24 to 27, wherein the permeable hydrophobic media comprises at least one of a polytetrafluoroethylene (PTFE) material or a polyurethane material that has been manipulated such that it is substantially hydrophobic.
29. The fractionation system of any of paragraphs 24 to 28, wherein the permeable oleophobic media comprises a polyurethane material that has been manipulated such that it is substantially oleophobic.
30. A well completion, comprising: a wellbore comprising a production tubing positioned within the wellbore, the production tubing having a surface end proximate a surface location and a subsurface end proximate a subsurface region; a production region in the wellbore in an annular area between the wellbore and the production tubing for receiving therein a production fluid from the subsurface region, the production fluid comprising oil and water; and a fractionation system positioned within the wellbore on a subsurface end of the production tubing and in hydraulic communication with the production region, the fractionation system comprising: a permeable hydrophobic media comprising (i) an effective permeability to oil through the permeable hydrophobic media that conveys at least an oil-enriched portion of the production fluid from the production region along a first flow path conveying oil from the production region, through the permeable hydrophobic media, and into the production tubing, and (ii) simultaneously an effective permeability to water through the permeable hydrophobic media that impedes conveyance of water from the wellbore region into the production tubing; and a permeable oleophobic media comprising (i) an effective permeability to water through the permeable oleophobic media that conveys at least a water-enriched portion of the production fluid from the production region to a second flow path hydraulically isolated from the first flow path, the second flow path conveying water from the permeable oleophobic media to another subsurface region of the wellbore for disposal of the conveyed water, and (ii) simultaneously an effective permeability to oil through the permeable oleophobic media that impedes conveyance of oil from the production region to the second flow path; wherein the production region is in simultaneous fluid communication with a reservoir, the permeable hydrophobic media, and the permeable oleophobic media.
31. The well completion of paragraph 30, wherein the permeable hydrophobic media covers a plurality of perforations on the subsurface end of the production tubing, and wherein the oil-enriched stream flows through the permeable hydrophobic media and into the production tubing via the plurality of perforations.
32. The well completion of paragraph 30 or 31, wherein the permeable oleophobic media covers a fluid inlet for the second flow path, and wherein the water-enriched stream flows through the permeable oleophobic media and into the second flow path via the fluid inlet.
33. The well completion of any of paragraphs 30 to 32, wherein a thickness, porosity, a permeability, and a wettability of the permeable hydrophobic media and the permeable oleophobic media are specifically tailored to separate the production fluid into the oil-enriched stream and the water-enriched stream.
34. The well completion of any of paragraphs 30 to 33, wherein the permeable hydrophobic media comprises at least one of a polytetrafluoroethylene (PTFE) material or a polyurethane material that has been manipulated such that it is substantially hydrophobic.
35. The well completion of any of paragraphs 30 to 34, wherein the permeable oleophobic media comprises a polyurethane material that has been manipulated such that it is substantially oleophobic.
36. The well completion of any of paragraphs 30 to 35, wherein the second flow path comprises an annulus between the production tubing and a production casing.
37. The well completion of paragraph 36, comprising a production packer for sealing the annulus proximate the subsurface end of the production tubing, wherein the second flow path allows the water-enriched stream to bypass the production packer to enter the annulus of the well completion.

38. The well completion of any of paragraphs 30 to 35, wherein the well completion comprises a dual completion, and wherein the second flow path comprises a second production tubing that is strung alongside the production tubing.

39. The well completion of any of paragraphs 30 to 35, wherein the well completion comprises a dual concentric completion, and wherein the second flow path comprises a second production tubing that is concentric with the production tubing.

40. The well completion of any of paragraphs 30 to 39, wherein the fractionation system is configured such that the permeable hydrophobic media and the permeable oleophobic media can be periodically replaced.

41. A method for producing fluid from a subsurface region using a wellbore, the method comprising: positioning a production tubing within a wellbore, the production tubing having a surface end proximate a surface location and a subsurface end proximate a subsurface region; flowing a wellbore fluid from the subsurface region into a production region in the wellbore, the production region located hydraulically intermediate the subsurface region and the production tubing, the wellbore fluid comprising an immiscible combination of a hydrocarbon phase and a water phase; and providing a fractionation system within the wellbore on a subsurface end of the production tubing and forming a portion of the production tubing, the fractionation system in hydraulic communication with the production region, and the fractionation system separating at least a portion of the hydrocarbon phase from at least a portion of the water phase by the steps of; (a) preferentially conveying at least a portion of the hydrocarbon phase from the production region along a first hydraulic flow path through a permeable hydrophobic media and into the production tubing while inhibiting flow of the water phase along the first hydraulic flow path to the production tubing, wherein the first hydraulic flow path along the permeable hydrophobic media includes (i) an effective permeability to the hydrocarbon phase fluid in the production region, and (ii) simultaneously, a lower effective permeability to the water phase fluid in the production region relative to the effective permeability to the hydrocarbon phase fluid; and (b) preferentially conveying at least a portion of the water phase from the production region along another hydraulic flow path through a permeable oleophobic media to another region within the wellbore for water disposition, while restricting conveyance of the hydrocarbon phase through the oleophobic media, wherein the another hydraulic flow path along the permeable oleophobic media includes (i) an effective permeability to the water phase fluid from the production region that conveys water from the production region through the permeable oleophobic media, and (ii) simultaneously, a restrictive effective permeability to the hydrocarbon phase fluid from the production region through the permeable oleophobic media relative to the effective permeability of the permeable oleophobic media to the water phase fluid; wherein the fractionation system conveys at least one of a hydrocarbon fluid and a hydrocarbon-enriched fluid cut from the hydrophobic media into the production tubing, with respect to a hydrocarbon cut of the produced fluid conveyed from the subsurface region within the production region of the wellbore.

42. The method of paragraph 41, wherein the lower effective permeability to the water phase fluid from the production region relative to the effective permeability to the hydrocarbon phase fluid comprises: providing the permeable hydrophobic media with an effective permeability to the water phase fluid that is not greater than one-half (50%) of the effective permeability of the permeable hydrophobic media to the hydrocarbon phase fluids such that the permeable hydrophobic media permits conveyance of a portion of the water phase fluid from the production region into the production tubing while simultaneously at least a portion of the water phase fluid from the production region is conveyed along the another hydraulic flow path through the permeable oleophobic media to another region within the wellbore for separated water collection.

43. The method of paragraph 41, wherein the lower effective permeability to the water phase fluid from the production region relative to the effective permeability to the hydrocarbon phase fluid comprises: providing the permeable hydrophobic media with an effective permeability to the water phase fluid that is not greater than one-quarter (25%) of the effective permeability of the permeable hydrophobic media to the hydrocarbon phase fluids such that the permeable hydrophobic media permits conveyance of a portion of the water phase fluid from the production region into the production tubing while simultaneously at least a portion of the water phase fluid from the production region is conveyed along the another hydraulic flow path through the permeable oleophobic media to another region within the wellbore for separated water collection.

44. The method of paragraph 41, wherein the lower effective permeability to the water phase fluid from the production region relative to the effective permeability to the hydrocarbon phase fluid comprises: providing the permeable hydrophobic media with an effective permeability to the water phase fluid that is not greater than one-tenth (10%) of the effective permeability of the permeable hydrophobic media to the hydrocarbon phase fluids such that the permeable hydrophobic media permits conveyance of a portion of the water phase fluid from the production region into the production tubing while simultaneously at least a portion of the water phase fluid from the production region is conveyed along the another hydraulic flow path through the permeable oleophobic media to another region within the wellbore for separated water collection.

45. The method of paragraph 41, wherein the lower effective permeability to the water phase fluid from the production region relative to the effective permeability to the hydrocarbon phase fluid comprises: providing the permeable hydrophobic media with an effective permeability to the water phase fluid that is not greater than two one-hundredths (2%) of the effective permeability of the permeable hydrophobic media to the hydrocarbon phase fluids such that the permeable hydrophobic media permits conveyance of a portion of the water phase fluid from the production region into the production tubing, while simultaneously at least a portion of the water phase from the production region is conveyed along the another hydraulic flow path through the permeable oleophobic media to another region within the wellbore for separated water collection.

46. The method of paragraph 41, wherein the restrictive effective permeability of the permeable oleophobic media to the hydrocarbon phase fluid from the production region relative to the effective permeability to the water phase fluid comprises: providing the permeable oleophobic media with an effective permeability to the hydrocarbon phase fluid that is not greater than one-tenth (10%) of the effective permeability of the permeable oleophobic media to the water phase fluid such that the permeable oleophobic media restricts conveyance of the hydrocarbon phase fluid from the production region through the permeable oleophobic media.

47. The method of paragraph 41, wherein the restrictive effective permeability of the permeable oleophobic media to the hydrocarbon phase fluid from the production region relative to the effective permeability to the water phase fluid comprises: providing the permeable oleophobic media with an effective permeability to the hydrocarbon phase fluid is not greater than five one-hundredths (5%) of the effective permeability of the permeable oleophobic media to the water phase fluid such that the permeable oleophobic media restricts conveyance of the hydrocarbon phase fluid from the production region through the permeable oleophobic media.

48. The method of paragraph 41, wherein the restrictive effective permeability of the permeable oleophobic media includes a relative permeability of the oleophobic media to the hydrocarbon phase fluids from the production region is effectively zero.

49. The method of paragraph 41, wherein the restrictive effective permeability of the permeable oleophobic media to the hydrocarbon phase fluid from the production region relative to the effective permeability to the water phase fluid comprises: providing the permeable oleophobic media with an effective permeability to the hydrocarbon phase fluid is not greater than three one-hundredths (3%) of the effective permeability of the permeable oleophobic media to the water phase fluid such that the permeable oleophobic media restricts conveyance of the hydrocarbon phase fluid from the production region through the permeable oleophobic media.

50. The method of paragraph 41, wherein the restrictive effective permeability of the permeable oleophobic media to the hydrocarbon phase fluid liquid from the production region relative to the effective permeability to the water phase fluid comprises: providing the permeable oleophobic media with an effective permeability to the hydrocarbon phase fluid that is not greater than two one-hundredths (2%) of the effective permeability of the permeable oleophobic media to water such that the permeable oleophobic media restricts conveyance of the hydrocarbon phase fluid from the production region through the permeable oleophobic media.

51. The method of paragraph 41, wherein the restrictive effective permeability of the permeable oleophobic media to the hydrocarbon phase fluid liquid from the production region relative to the effective permeability to the water phase fluid comprises: providing the permeable oleophobic media with zero effective permeability to the hydrocarbon phase fluid such that the permeable oleophobic media prevents conveyance of the hydrocarbon phase fluid from the production region through the permeable oleophobic media.

Embodiments described herein are merely explanatory and exemplary of various embodiments and aspects of the apparatus and methods for use of the fractionation system for separating a production fluid into an oil-enriched stream and a water-enriched stream within a well completion. However, the fractionation system may also be used for any other application for which it is desirable to separate a fluid including oil and water into an oil-enriched stream and a water-enriched stream. Moreover, while the embodiments described herein are well-calculated to achieve the advantages set forth, it will be appreciated that the embodiments described herein are susceptible to modification, variation, and change without departing from the spirit thereof. Indeed, the present techniques include all alternatives, modifications, and equivalents falling within the true spirit and scope of the appended claims.

What is claimed is:

1. A well completion, comprising:

a wellbore comprising a production tubing positioned within the wellbore, the production tubing having a surface end proximate a surface region and a subsurface end proximate a subsurface region, the production tubing conveying a portion of a production fluid from the subsurface region to the surface region; and a fractionation system positioned within the wellbore on the subsurface end of the production tubing proximate to a production region of the wellbore, the fractionation system comprising:

a permeable hydrophobic media for preferentially conveying at least a first portion of the production fluid from the production region into the production tubing; and a permeable oleophobic media for preferentially conveying at least a second portion of the production fluid from the production region into a second flow path, wherein the second flow path comprises an annulus between the production tubing and a production casing, and wherein the permeable oleophobic media covers a fluid inlet of the second flow path that is defined between the production tubing and a production packer that leads to the annulus;

wherein the permeable hydrophobic media and the permeable oleophobic media are in simultaneous hydraulic communication with the production region;

wherein the permeable hydrophobic media is manufactured to provide a relatively high effective permeability to oil, whereby the first portion of the production fluid comprises an oil-enriched stream that flows through the permeable hydrophobic media into the production tubing and is conveyed to the surface region; and wherein the permeable oleophobic media is manufactured to provide a relatively high effective permeability to water, whereby the second portion of the production fluid comprises a water-enriched stream that flows through the permeable oleophobic media into the second flow path for disposing of the water-enriched stream.

2. The well completion of claim 1, wherein the permeable hydrophobic media covers a plurality of perforations on the subsurface end of the production tubing, and wherein the oil-enriched stream flows through the permeable hydrophobic media and into the production tubing via the plurality of perforations.

3. The well completion of claim 1, wherein the permeable hydrophobic media comprises at least one of a polytetrafluoroethylene (PTFE) material or a polyurethane material that has been manipulated such that it is substantially hydrophobic.

4. The well completion of claim 1, wherein the permeable oleophobic media comprises a polyurethane material that has been manipulated such that it is substantially oleophobic.

5. The well completion of claim 1, wherein the well completion comprises a dual concentric completion, and wherein the second flow path comprises a second production tubing that is concentric with the production tubing.

6. A method for separating production fluid in a subsurface region within a wellbore, comprising:

flowing a production fluid from a reservoir into a production region of a wellbore, wherein the production region is located within a subsurface region of the wellbore that is proximate to a subsurface end of a production tubing positioned within the wellbore;

conveying at least a first portion of the production fluid from the production region into the production tubing via a fractionation system, wherein the fractionation system is positioned within the wellbore on the subsurface end of the production tubing, wherein the fractionation system comprises a permeable hydrophobic media and a permeable oleophobic media that are in simultaneous hydraulic communication with the production region, and wherein the permeable hydrophobic media is manufactured to provide a relatively high effective permeability to oil, whereby the first portion of the production fluid comprises an oil-enriched stream that flows through the permeable hydrophobic media into the production tubing and is conveyed to a surface region of the wellbore; and conveying at least a second portion of the production fluid from the production region into a second flow path via the fractionation system, wherein the second flow path comprises an annulus between the production tubing and a production casing, wherein the permeable oleophobic media covers a fluid inlet of the second flow path that is defined between the production tubing and a production packer that leads to the annulus, and wherein the permeable oleophobic media is manufactured to provide a relatively high effective permeability to water, whereby the second portion of the production fluid comprises a water-enriched stream that flows through the permeable oleophobic media into the second flow path for disposing of the water-enriched stream.

7. The method of claim 6, comprising injecting the water-enriched stream into another subsurface region of the wellbore via the second flow path.

8. The method of claim 6, comprising conveying the water-enriched stream to the surface region via the second flow path.

9. The method of claim 6, wherein a thickness, a porosity, a permeability, and a wettability of the permeable hydrophobic media and the permeable oleophobic media are specifically tailored to separate the production fluid into the oil- enriched stream and the water-enriched stream within the subsurface.

10. The method of claim 6, wherein the permeable hydrophobic media comprises at least one of a polytetrafluoroethylene (PTFE) material or a polyurethane material that has been manipulated such that it is substantially hydrophobic.

11. The method of claim 6, wherein the permeable oleophobic media comprises a polyurethane material that has been manipulated such that it is substantially oleophobic.

12. The method of claim 6, wherein disposing of the water-enriched stream via the second flow path comprises flowing the water-enriched stream into the annulus.

13. A fractionation system, comprising:

a permeable hydrophobic media; and a permeable oleophobic media;

wherein the permeable hydrophobic media and the permeable oleophobic media are in simultaneous hydraulic communication with a fluid comprising oil and water;

wherein the permeable hydrophobic media is manufactured to provide a relatively high effective permeability to oil, whereby an oil-enriched stream flows through the permeable hydrophobic media into a first flow path; and wherein the permeable oleophobic media is manufactured to provide a relatively high effective permeability to water, whereby a water-enriched stream flows through the permeable oleophobic media into a second flow path, wherein the second flow path comprises an annulus between a production tubing and a production casing of a wellbore, and wherein the permeable oleophobic media covers a fluid inlet of the second flow path that is defined between the production tubing and a production packer that leads to the annulus.

14. The fractionation system of claim 13, wherein the fractionation system is implemented within a wellbore; the fluid comprises a production fluid; and the fractionation system is used to separate the production fluid into the oil-enriched stream and the water-enriched stream within a subsurface region of the wellbore.

15. The fractionation system of claim 13, wherein a thickness, a porosity, a permeability, and a wettability of the permeable hydrophobic media and the permeable oleophobic media are specifically tailored to separate the fluid into the oil-enriched stream and the water-enriched stream.

16. The fractionation system of claim 13, wherein the permeable hydrophobic media comprises at least one of a polytetrafluoroethylene (PTFE) material or a polyurethane material that has been manipulated such that it is substantially hydrophobic.

17. The fractionation system of claim 13, wherein the permeable oleophobic media comprises a polyurethane material that has been manipulated such that it is substantially oleophobic.

* * * * *